United States Patent [19]

Yuh et al.

[11] Patent Number: 5,063,125

[45] Date of Patent: Nov. 5, 1991

[54] ELECTRICALLY CONDUCTIVE LAYER FOR ELECTRICAL DEVICES

[75] Inventors: Huoy-Jen Yuh, Pittsford; John W. Spiewak, Webster; Constance J. Thornton, Ontario; John F. Yanus, Webster; William W. Limburg; Joseph Mammino, both of Penfield, all of N.Y.

[73] Assignee: Xerox Corporation, Stamford, Conn.

[21] Appl. No.: 458,937

[22] Filed: Dec. 29, 1989

[51] Int. Cl.[5] ..... G03G 5/14

[52] U.S. Cl. ..... 430/59; 430/63; 430/64

[58] Field of Search ..... 430/58, 59, 60, 62, 430/64, 65, 63

[56] References Cited

U.S. PATENT DOCUMENTS

| | | | |
|---|---|---|---|
| 3,113,022 | 12/1963 | Cassiers et al. | 96/1 |
| 3,245,833 | 4/1966 | Trevoy | 117/201 |
| 3,295,967 | 1/1967 | Schoenfeld | 96/1.5 |
| 3,428,451 | 2/1969 | Trevoy | 96/1 |
| 3,554,742 | 1/1971 | Perry | 96/1.5 |
| 3,640,708 | 2/1972 | Humphries et al. | 96/1.5 |
| 3,745,005 | 7/1973 | Yaeger et al. | 96/1.5 |
| 3,776,724 | 12/1973 | Usmani | 96/1.8 |
| 3,932,179 | 1/1976 | Perez-Albuerse | 96/1.5 |
| 4,082,551 | 4/1978 | Stekleaski et al. | 96/1 PC |
| 4,242,053 | 4/1981 | Burwasser | 428/327 |
| 4,410,614 | 10/1983 | Lelental et al. | 430/45 |
| 4,434,218 | 2/1984 | Tarumi et al. | 430/96 |
| 4,464,450 | 8/1984 | Teuscher | 430/59 |
| 4,465,751 | 8/1984 | Kawamura et al. | 430/64 |
| 4,472,474 | 9/1984 | Grosheim et al. | 428/195 |
| 4,485,161 | 11/1984 | Scazzafava et al. | 430/64 |
| 4,490,452 | 12/1984 | Champ et al. | 430/58 |
| 4,584,253 | 4/1986 | Lin et al. | 430/59 |
| 4,664,995 | 5/1987 | Horgan et al. | 430/69 |

FOREIGN PATENT DOCUMENTS 20096009 2/1972 United Kingdom .

OTHER PUBLICATIONS

Koji Abe, Mikis-Koide & Cishum Teuhida, Macromolecules 10 (6) 1259-64 (1977).

M. M. Coleman and D. J. Strovanek, Conference Proceeding of 44th Antel, 321-322 (1986).

*Primary Examiner*—John Goodrow

[57] ABSTRACT

A device containing a substrate and an electrically conductive layer including a film forming continuous phase containing a charge transport compound and finely divided electrically conductive particles dispersed in the continuous phase. This device may be coated with at least one photoconductive layer and used in an imaging process.

20 Claims, No Drawings

ELECTRICALLY CONDUCTIVE LAYER FOR ELECTRICAL DEVICES

BACKGROUND OF THE INVENTION

This invention relates in general to electrically conductive layers and, more specifically, to novel electrically conductive devices and process for using the devices.

In the art of xerography, a xerographic plate containing a photoconductive insulating layer is imaged by first uniformly electrostatically charging its surface. The plate is then exposed to a pattern of activating electromagnetic radiation which selectively dissipates the charge in the illuminated areas of the photoconductive insulator while leaving behind an electrostatic charge pattern in the nonilluminated areas. This resulting electrostatic latent image may then be developed to form a visible image by depositing finely divided electroscopic marking particles on the surface of the photoconductive insulating layer.

A photoconductive layer for use in xerography may be a homogeneous layer of a single material such as vitreous selenium or it may be a composite layer containing a photoconductor and another material. One type of composite photoconductive layer used in xerography is illustrated in U.S. Pat. No. 4,265,990 which describes a photosensitive member having at least two electrically operative layers. One layer comprises a photoconductive layer which is capable of photogenerating holes and injecting the photogenerated holes into a contiguous charge transport layer. Generally, where the two electrically operative layers are supported on a conductive layer with the photoconductive layer sandwiched between the contiguous charge transport layer and a supporting conductive layer, the outer surface of the charge transport layer is normally charged with a uniform charge of a negative polarity and the supporting electrode is utilized as an anode. Obviously, the supporting electrode may also function as an anode when the charge transport layer is sandwiched between the anode and a photoconductive layer which is capable of photogenerating electrons and injecting the photogenerated electrons into the charge transport layer. The charge transport layer in this embodiment, of course, must be capable of supporting the injection of photogenerated electrons from the photoconductive layer and transporting the electrons through the charge transport layer.

Various combinations of materials for charge generating layers (CGL) and charge transport layers (CTL) have been investigated. For example, the photosensitive member described in U.S. Pat. No. 4,265,990 utilizes a charge generating layer in contiguous contact with a charge transport layer comprising a polycarbonate resin and one or more of certain diamine compounds. Various generating layers comprising photoconductive layers exhibiting the capability of photogeneration of holes and injection of the holes into a charge transport layer have also been investigated. Typical photoconductive materials utilized in the generating layer include amorphous selenium, trigonal selenium, and selenium alloys such as selenium-tellurium, selenium-tellurium-arsenic, selenium-arsenic, and mixtures thereof. The charge generation layer may comprise a homogeneous photoconductive material or particulate photoconductive material dispersed in a binder. Other examples of homogeneous and binder charge generation layer are disclosed, for example, in U.S. Pat. No. 4,265,990. Additional examples of binder materials such as poly(hydroxyether) resins are taught in U.S. Pat. No. 4,439,507. The disclosures of the aforesaid U.S. Pat. No. 4,265,990 and U.S. Pat. No. 4,439,507 are incorporated herein in their entirety. Photosensitive members having at least two electrically operative layers as disclosed above provide excellent images when charged with a uniform negative electrostatic charge, exposed to a light image and thereafter developed with finely divided electroscopic marking particles to form a toner image.

When ground planes containing conductive particles dispersed in a resin binder are used in photoreceptors, difficulties can be encountered with non-uniform dispersion of the conductive particles in the binder. Agglomerates and other non-uniform dispersions of the conductive particles adversely affect the quality of the electrostatic charging, development, transfer and discharging cleaning processes.

Also, with ground planes containing conductive particles dispersed in a resin binder, difficulties can be encountered with migration of the resin binder and/or conductive particles into subsequently applied layers that contain solvents which at least partially dissolve the resin binder in the conductive layer. Such migration of the resin binder or conductive particles can adversely affect the integrity of the ground plane and the electrical properties of the ground plane and/or the subsequently applied layers. More specifically, polymers in the binders utilized for ground planes can migrate into the charge generating layer and cause charge trapping. When charge trapping occurs during cycling, internal fields build up and background prints out in the final printed copies. Further, conductive particles can move up to subsequently applied layers and prevent the photoreceptor from receiving a full electrostatic charge in the areas where the conductive material migrated. For example, migration of conductive particles such as carbon black into subsequently applied layers causes lower charge acceptance and perhaps $V_R$ cycle-up. The regions of lower charge acceptance appear as white spots in the final printed copy. Solvent attack can also cause discontinuities in the ground plane resulting in nonuniform charging which ultimately causes the formation of distorted images in the final toner image.

The conductivity of conductive layers should be stable in changing environments. However, the electrical conductivity of many conductive layers for photoreceptors are unstable and change with changes in ambient humidity. If the conductivity of the conductive layers deviate to too low a value due to changes in humidity, nonuniform charging of the surface photoreceptor can occur. This leads to nonuniform print quality.

INFORMATION DISCLOSURE STATEMENT

U.S. Pat. No. 4,490,452 issued to Champ et al. on Dec. 25, 1984—An aggregate-type xerographic photoconductor is disclosed for a primary or secondary amines are used not only to solubilize the photoconductor's light sensitive organic dye but also to act as a cross-linker for an epoxy binder of the bisphenol class. A combined CTL/CGL layer is described, having both hole transport and charge generating dye molecules. Hole transport materials such as diphenylhydrazone are also disclosed.

U.S. Pat. No. 4,434,218 issued to Tarumi et al. on Feb. 28, 1984—A photosensitive composition is disclosed including a photoconductive cadmium sulfide-group compound in a water-soluble prepolymer capable of forming a network structure by cross-linking, the composition being applied as a photosensitive layer of a photosensitive article for electrophotography having a conductive substrate. The prepolymer can cross-link to form a network structure by the action of light or heat, or may be of a type which is required to be mixed with a hardner or polymerization accelerator and cross-links at normal temperature or at elevated temperature, if required. The prepolymer contains hydroxyl groups or carboxyl groups or carboxyl groups which are combined with ammonia. It is preferred that these prepolymers have an acid value of not lower than 20. Where prepolymers having amino groups or substituted amino groups such as methanol amino group is used, it is preferred that the prepolymer has an amine value of not lower than 15. Numerous examples of prepolymers are described, for example, in columns 3–8. Various amphipathic solvents and neutralizing agents for the photosensitive composition described, for example, in column 9, lines 3–24. An intermediate conductive layer containing carbon, thermosetting alkyd resin and butril acid is described in column 11. A similar formulation for a conductive adhesive layer is also described in column 11. Similar intermediate conductor layers and conductive adhesive layers are described in column 14. Prepolymers of polyvinylalcohol, polyvinylpyrrolidone and polyvinylether which may be used singularly or in combination with acrylic acid, methacrylic acid or after thereof an acrylamide in the form of copolymers is described, for example, in column 8, lines 13–18.

U.S. Pat. No. 3,776,724 issued to Usmani on Dec. 4, 1973—An electrophotographic resin composition is disclosed comprising an acrylate, a vinyl monomer, and an acrylamide or polymerizable amine compound. This composition is particularly suitable for use as a binder in preparing zinc oxide coatings for paper used in reproducing images.

U.S. Pat. No. 3,932,179 issued to E. A. Perez-Albuerne on Jan. 13, 1976—A multilayer electrophotographic element is disclosed comprising a conducting layer, a photoconductive layer, and a polymeric interlayer having a surface resistivity greater than about $10^{12}$ ohm/sq between the conducting layer and the photoconductive layer. The interlayer comprises a blend of at least two distinct polymeric phases comprising: (a) a film forming water or alkali-water soluble polymer and (b) an electrically insulating, film forming, hydrophobic polymer. For example, the conducting layer may contain cuprous iodide imbibed in a copolymeric binder of polymethylmethacrylate and polymethacrylic acid. A complex two phase hazy layer, composed of a complex terpolymer (65 wt. percent) of poly(methylacrylate-vinylidene chloride-itaconic acid) and polyvinylmethylether maleic anhydride) (35 wt. percent) is employed as an organic solvent barrier, an adhesive aid, and a hole blocking layer. The film forming water or alkali-water soluble polymer may contain pendant side chains composed of groups such as acidic, hydroxy, alkoxy and ester groups.

U.S. Pat. No. 4,082,551 issued to Steklenski et al on Apr. 4, 1978—A unitary photoconductive element is disclosed having an electrically conducting layer, a photoconductive layer thereon, and a multilayer interlayer composition interposed between the conducting layer and the photoconductive layer. The multilayer interlayer composition comprises a layer containing an acidic polymer material, a layer containing a basic polymer material, and an acid-base reaction product zone formed at the interface of the acidic polymer-containing layer and the basic polymer-containing layer. The basic polymer materials appear to be basic because of the presence of amine groups. Various basic amino methacrylate and acrylate monomers and polymers are disclosed. Thus, for example, the complex barrier bilayer adjacent to a CuI conductive layer may be composed of an acrylic or methacrylic acid copolymer and the top layer composed of a poly 2-vinylpyridine-polymethylmethacrylate copolymer such that a salt interlayer forms at the interface of these acidic and basic polymers. The multilayer interlayer composition provides good adhesion between the conducting and photoconductive layers of the resultant unitary element and can function as an electrical barrier blocking positive charge carriers which might otherwise be injected into the photoconductive layer from the underlying conducting layer.

U.S. Pat. No. 4,584,253 issued to Lin et al on Apr. 22, 1986—An electrophotographic imaging member is disclosed comprising a charge generation layer, a contiguous charge transport layer and a cellulosic hole trapping material located on the same side of the charge transport layer as the charge generation layer. In one example, the cellulosic hole trapping material may be sandwiched between the charge generation layer and an electrically conductive layer.

U.S. Pat. No. 3,113,022 issued to P. Cassiers et al on Dec. 3, 1963—An electrophotographic imaging member for forming latent conductivity images is disclosed. The conductive layer for the member may include gold and various other materials such as a hydrophilic material comprising a hygroscopic and/or antistatic compound and a hydrophilic binding agent. Suitable hygroscopic and/or antistatic compounds include, for example, glycerine, glycol, polyethylene glycols, hydroxypropyl sucrosemonolaurate, etc. Suitable hydrophilic binding agents include gelatin, polyvinyl alcohol, methylcellulose, carboxymethylcellulose, cellulosesulphate, cellulose hydrogen phthalate, cellulose-acetatesulphate, hydroxyethyl cellulose, etc. for obtaining a good adhesion of a hydrophilic layer and a hydrophobic polymeric sheet. Also, a coating of a polymeric substance may be used on paper sheets to prevent organic polymeric photoconductive substance and radiation sensitive substance from penetrating within the paper sheet. The coating of a polymeric substance must not prevent the carrying off of electrons from exposed image areas during radiation. Coatings include cellulose diacetate, cellulose triacetate, cellulose acetobutyrate, ethyl cellulose, ethyl cellulose stearate or other cellulose derivatives, polymerisates such as polyacrylic acid esters, polymethacrylic acid esters, polycondensates such as polyethylene glycol esters, diethylene glycol polyesters, etc. An organic polymeric photoconductive substance together with a radiation-sensitive substance is dissolved or dispersed in an organic solvent and coated onto the surface of a suitable support.

U.S. Pat. No. 3,245,833 issued to D. Trevoy on Apr. 12, 1966—Electrically conductive coatings useful as antistatic coatings on photographic films are prepared from cuprous iodide and organic polymers in nitrile solvents (e.g. Example 6). Surface resistivities of $7\text{–}9\times10^3$ ohms/square were obtained after spin coating and drying. Thicknesses do not appear to be disclosed. Coating applications do not appear to be electrophotographic and a polymeric insulative binder is always used with the cuprous iodide wherein the semiconductor metal containing compound (CuI) is present in the 15–90 volume percent range.

U.S. Pat. No. 3,428,451 issued to D. Trevoy—Appears to employ some of the conductive coatings described in U.S. Pat. No. 3,245,833 (see above) for use in electrically conductive supports for radiation sensitive recording elements (e.g. an electron microscope where direct electron recording is carried out). Coating applications do not appear to be electrophotographic.

U.S. Pat. No. 3,554,742 issued to on Jan. 12, 1971—Conductive coatings (e.g. CuI and polymeric binder) described in U.S. Pat. No. 3,245,833 (see above) appear to be employed in electrophotographic applications. A binder is used with the cuprous iodide as the conductive layer. Barrier layers of block copolycarbonates located between the conductive layer (CuI and polymeric binder) and a photoconductive layer (e.g. thiapyrilium) improve adhesion to each and charging levels. However, no cyclic electrical data is provided.

U.S. Pat. No. 3,640,708 issued to W. D. Humphries et al—A mixture of CuI and polymeric binder is employed as a conductive layer for electrophotographic devices. Barrier layers, located as described in reference (3), of a polymeric blend of cellulose nitrate and a complex tetrapolymer of methyl acrylate, acrylonitrile, acrylic acid and vinylidene chloride having a thickness of 0.3 to 0.5 micrometer were found to reduce dark decay and improve adhesion. No cyclic electrical data is provided.

U.S. Pat. No. 3,745,005 issued to W. E. Yoerger et al—A mixture of cuprous iodide in a polymeric binder (polyvinylformal) is employed as a conductive layer. A barrier layer (0.3–7 micrometers) consists of a copolymer of vinylacetate and vinylpyrrolidone or vinylacetate and an $\alpha\beta$-unsaturated monoalkenoic acid gives charging levels in the range of 600 to 700 volts in an RH range of 15–80 percent. Claims 3 and 7 refer to conductive layers of carbon dispersed in a binder although this kind of conductive layer is not discussed elsewhere in this patent. No cyclic electrical data is provided.

U.S. Pat. No. 4,485,161 issued to M. Scozzafava et al—Conductive layers containing cuprous iodide in the polymeric binders are disclosed. Barrier layers were solution or bulk coated from polymerizable and cross-linkable monomers having at least one acrylate or methacrylate group and also having an aromatic nucleus or cycloaliphatic nucleus. The barrier layer coating also contained small amounts of a photosensitizer and an amine activator required to promote UV radiation cure of the neat monomer coating. Dry barrier layer coating thicknesses of 2–8 micrometers were obtained. These devices were capable of supporting electric fields of 1.3 to $1.6\times10^6$ volts/cm under corona charging. The $E_{\frac{1}{2}}$ photosensitivity was about 10 ergs/cm$^2$ (Example 3) of 640 nm inicident light. The $E_{\frac{1}{3}}$ photosensitivity (Examples 2, 4, 5 and 6) ranged from 6.7–14.9 ergs/cm$^2$ using the same light source. No test of a barrier layer $V_O$ and $V_R$ behavior with repeated xerographic cycling is given. The above data is for only one cycle. These cross-linked barrier layers do reduce the number of white spots produced in the imaged film. The barrier layer also functions as a solvent barrier to toluene and methylene chloride in addition to its electrical function as a hole injection barrier.

U.S. Pat. No. 4,465,751 issued to K. Kawamura et al—The formation of cuprous iodide conductive layers are disclosed wherein the cuprous iodide is imbibed into the polymeric substrate or a subbing adhesive layer on the polymeric substrate when the cuprous iodide-acetonitrile solution is coated without a binder in the same solution. Thus, a binder for the cuprous iodide is generated underneath the CuI by appropriate solvent swelling and/or heat and the result is a CuI-binder conductive layer. Optionally, a CuI-polymer conductive layer wherein cellulose acetate butyrate is used as the polymeric binder is coated directly. The CuI is imbibed and no distinct CuI layer remains.

U.S. Pat. No. 4,410,614 issued to Lelental et al on Oct. 18, 1983—An electrically activatable recording element is disclosed comprising a polymeric electrically active conductive layer. A list of useful copolymers for the polymeric electrically active conductive layer includes many polymethacrylates can be found at column 6, lines 36–62. Synthetic polymers are preferred as vehicles and binding agents in the layers of the electrically activatable recording element. The use of polymers such as poly(vinylpyrrolidone), polystyrene and poly(vinylalcohol) is disclosed at column 11, lines 14–58.

U.S. Pat. No. 4,262,053 issued to Burwasser on Apr. 14, 1981—An antiblocking agent for dielectric film for electrostatographic recording is disclosed. The dielectric imaging element may comprise a dielectric film, a film support and conductive layers. The conductive layers include polymers such as quaternized polymers of vinylpyridine with aliphatic esters, polymers of polyacrylic acid salts with metallic coated polyester films, and the like. The conductive layers may be coated with various dielectric resins including styrenated acrylics.

Koji Abe, Mikio-Koide and Eishum Tcuchida, *Macromolecules* 10 (6), 1259–64 (1977)—A polymeric complex is prepared from 4-vinylpyridine (a basic polymer) and polymethyl acrylic acid (an acidic polymer) to vie a significant amount of the ionized salt structure (FIG. III).

M. M. Coleman and D. J. Skrovanek, Conference Proceeding of 44th ANTEC, 321–2 (1986)—Poly-2-vinylpyridine is shown to interrupt routine hydrogen bonding in an amorphous neutral nylon polymer. The neutral polymer provides an amide hydrogen as a hydrogen bonding site.

U.S. Pat. No. 3,295,967 issued to S. J. Schoenfeld on Jan. 3, 1967—An electrophotographic recording member is disclosed which contains a non-metallic base of high electrical resistivity, a coating on the base for increasing the electrical conductivity, the coating comprising gelatinous hydrated silicic acid and a hygroscopic hydrated inorganic salt, and a photoconductive stratum covering the coating.

U.S. Pat. No. 4,464,450 issued to L. A. Teuscher on Aug. 7, 1984—an electrostatographic imaging member is disclosed having electrically operative layers overlying a siloxane film coated on a metal oxide layer of a metal conductive anode, the siloxane having reactive OH and ammonium groups attached to silicon atoms.

U.K. Patent Application GB 2 009 600 A to Tadaju Fukuda et al, published Apr. 23, 1982—A photoconductive member is disclosed comprising a support, a photoconductive layer constituted of an amorphous material comprising silicon atoms as a matrix and a barrier layer between the support and the photoconductive layer, the barrier layer comprising a first sub-layer constituted of an amorphous material comprising silicon atoms as a matrix and containing an impurity which controls the conductivity and a second sub-layer constituted of an electrically insulating material different from the amorphous material constituting the first sub-layer.

Thus, the characteristics of photosensitive members comprising a support having an electrically conductive charge injecting surface, a blocking layer and at least one photoconductive layer, exhibit deficiencies as electrophotographic imaging members.

SUMMARY OF THE INVENTION

It is an object of the invention to provide a device and process of preparing and using same which overcomes the above-noted disadvantages.

It is an another object of this invention to provide a device having a conductive layer in which is humidity insensitive.

It is an another object of this invention to provide a device having a conductive layer in which conductive particles are uniformly dispersed.

It is an another object of this invention to provide a device having a conductive layer which can be semi-transparent.

It is an another object of this invention to provide an electrostatographic imaging member having extend life.

It is an another object of this invention to provide an electrostatographic imaging member that charges to high voltages useful in xerography.

It is an another object of this invention to provide an electrostatographic imaging member which is more dark stable.

It is an another object of this invention to provide an electrostatographic imaging member which allows photodischarge with low residual voltage during cycling.

It is an another object of this invention to provide an electrostatographic imaging member that is simpler to fabricate.

It is an another object of this invention to provide an electrostatographic imaging member having a ground plane layer that is resistant to disturbance or dissolving by components of subsequently applied layers.

These and other objects of the present invention are accomplished by providing a device comprising a substrate and an electrically conductive layer comprising a film forming continuous phase comprising a charge transport compound and finely divided electrically conductive particles dispersed in the continuous phase.

The device of this invention may be used for many applications such as ground planes for photoreceptors and electrographic imaging members, electrodes in solar cells, electrical shieldings for electronic devices, stable electrodes for other electronic devices, and the like.

The substrate may comprise any suitable rigid or flexible member. The substrate may be opaque or substantially transparent and may comprise numerous suitable materials having the required mechanical properties. For example, it may comprise an electrically insulating support layer. Typical underlying flexible support layers include insulating or non-conducting materials comprising various film forming polymers or mixtures thereof with or without other suitable materials. Typical polymers include, for example, polyesters, polycarbonates, polyamides, polyurethanes, and the like. The supporting substrate layer carrying the electrically conductive layer may have any number of different configurations such as, for example, a sheet, a cylinder, a scroll, an endless flexible belt, and the like. Preferably, for photoreceptor applications, the flexible supporting substrate layer comprises a endless flexible polymeric web.

The electrically conductive layer comprises a film forming continuous phase comprising a charge transport compound and finely divided electrically conductive particles uniformly dispersed in the continuous phase.

Any suitable electrically conductive particles may be utilized in the electrically conductive layer of this invention. Typical electrically conductive particles include, for example, conductive carbon black, aluminum, titanium, nickel, chromium, brass, gold, stainless steel, graphite, metalloids, cuprous iodide, indium tin oxide alloys, copper iodide, gold and other noble metals, platinum, polypyrrole, polyaromatic conducting polymers, polythiothenes, conducting metallic oxide such as antimony tin oxide, indium tin oxide, and the like. Preferably, the electrically conductive particles have an average particle size of less than about 10 micrometers. The conductivity of the particles should be at least about 1 $(ohm.cm)^{-1}$.

For semi-transparent conductive layers, electrically conductive particles having an average particle size less than about 1 micrometer and having an acidic or substantially neutral outer surface are particularly preferred. The acid or base terminology as used in this application is defined by conventional Lewis acid-base terms. Thus, a Lewis acid is an electron acceptor and a Lewis base is an electron donor. The acidic or neutral outer surface of the conducting particles can allow partial charge exchange (Lewis acid-base interaction) with a basic polymer solution. Therefore, the wetting of the acidic conducting particles by the basic polymer solution is enhanced and aggregration of the conducting particles is minimized. The acidic or neutral outer surface of the electrically conductive particles should preferably have a pH between about 3 and about 7. Any suitable and conventional means may be utilized to measure pH. A typical technique merely involves the use of a conventional instrument such as a pH meter. Thus, the material can be well dispersed or disolved in a high dilectric solvent or solvent mixture medium (dielectric constant greater than about 10) to allow charge exchange dissociation occur. When the pH exceeds about 7, the wetting of the acidic conductive particles by the basic polymeric solution is not conductive to a good quality and stable dispersion of conducting particles. Coatings prepared from unstable or poor dispersions will not exhibit uniform transparency and conductivity. At a pH of about 7 or less, the charge exchange between the conducting particles and the polymer solution is strong. Thus, the wetting of the conducting particles by the polymeric solution is enhanced and the resulting dispersion quality is good. Typical electrically conductive particles having an acidic or substantially neutral outer surface include, for example, carbon black (C-975 Ultra, available from Columbian Chemicals Co. having a pH of 7; Vulcan XC-72R, available from Cabot Corp. having a pH of 5.7; Vulcan 6, available from Cabot Corp. having a pH of 7 and the like). Other electrically conductive particles having an electron accepting preperties include, for example, electron accepting metal oxide particles such as tin oxide, antimony oxide and the like. Other typical electrically conductive particles include, for example, aluminum, titanium, nickel, chromium, brass, gold, stainless steel, graphite, metalloids, cuprous iodide, indium tin oxide alloys, copper iodide, gold and other noble metals, platinum, polypyrrole, polyaromatic conducting polymers, polythiothenes, and the like. These metal or metal oxide materials are electron acceptors when dispersed in solutions more basic (or in Lewis acid-base term, less electron affinity) than the metal or metal oxide. The electron accepting characteristics of the metal oxide or metal particles allow similar charge exchange with basic polymer solutions which leads to good wetting of the conducting particles by the polymer solution and, therefore, good, stable dispersions of small conductive particles. Satisfactory transparency for thin conductive coatings may be achieved with conductive particles having an average particle size of less than about 1 micrometer. An average particle size between about 0.6 micrometer and about 0.06 micrometer is preferred because greater transparency is achieved. The conductive particle size should be sufficiently small so that the final thin, dried, conductive coating is semi-transparent to light and electrically conductive. The thickness of the continuous conductive layer is preferably less than about 50 micrometers for satisfactory semi-transparency. More specifically, the conductive layers may be between about 0.1 micrometer and about 50 micrometers. A conductive layer of between about 0.5 micrometers and about 5 micrometers is preferred because good transparency can always be achieved. Preferably, the transparency of the dried conductive layer should be at least about 5 percent for both visible and near infrared light and for adequate discharge of the photoconductive layer when used as a tranaparent ground plane in photoreceptors.

The thickness of the continuous non-transparent conductive layer is preferably less than about 500 micrometers. More specifically, the conductive layers may be between about 0.1 micrometer and about 200 micrometers. A conductive layer of between about 0.5 micrometers and about 100 micrometers is preferred because good conductivity and flexability can always be achieved. Moreover, for non-transparent conductive layers, the electrically conductive particles preferably have an average particle size of less than about 10 micrometers.

The conductive particle loading is preferably at least about 5 volume percent of the total solid content of the coating mixture. If the loading is less than about 5 volume percent and below the percolation threshold of electrical conductivity, the resistivity of the dried coating will increase sharply with a slight change of the conductive particle doping ratio and the reproducibility of the coating resistivity becomes very difficult to control. The conductive particle loading is preferably be less than about 70 volume percent of the total solid content of the coating mixture for non-transparent conductive particles and less than about 40 volume percent for transparent conductive particles because with excessive loadings, the conductive particle dispersion quality is likely to be poor. For optimum results, the conductive particle loading should be between about 15 and about 30 volume percent of the total solid content of the coating mixture. The resistivity of the dried, electrically conductive coating is preferably less than about $10^8$ ohms/square for efficient photoreceptor discharge during repeated cycling.

Any suitable solution of a film forming, preferably crosslinkable, polymer dissolved in a solvent may be utilized for applying the conductive particles. The polymer for the binder matrix (continuous phase) in the copnductive layer may be a single homopolymer or copolymer or a blend of at least two homopolymers or copolymers. Typical polymers include, for example, polyvinyl alcohol, polyvinyl pyrrolidone, polyester, and the like. Any other suitable film forming polymer may be utilized in the conductive coating. The polymers are also preferrably cross-linkable. Typical cross-linkable film forming polymers include poly methyl acrylamidoglycolate alkyl ether, poly(oxydiethylene maleate, styrene-maleic anhydride copolymer, N-phenyl maleimide-styrene copolymer, N-cyclohexyl maleimide-vinyl chloride copolymer and the like. Other typical film forming polymers include, for example, polystyrene, polycarbonate, polyester, methyl acrylamidoglycolate alkyl ether-vinyl acetate copolymer and the like.

A basic solution of a film forming, preferably cross-linkable polymer dissolved in a solvent may be utilized as the binder for acidic conductive particles, particularly for semi-transparent conductive layers. Although the combination of the polymer and solvent should be basic for this embodiment, the basic properties of the solution may be imparted to the solution by a basic polymer, a basic polymer or a combination of a basic polymer and a basic solvent. Thus, the polymer need not be very basic, a basicity around 8 would be suitable, if the solvent is basic, or vice versa. A basic polymer would prevent the aggregation of the conductive particles during the drying stage. Satisfactory results may be achieved with a basic solution having a pH of between about 8 and about 14. At a pH of less than about 8, the charge exchange between the polymeric solution and the conductive particle surfaces is not sufficiently strong to provide a good wetting of the conductive particles by the polymer solution and the conductive particles will tend to aggregate and the dispersion will be less stable. The pH value of the solution may be determined by any suitable technique such as by using a conventional pH meter.

The polymer for the binder matrix for semitransparent copnductive layers can be a single homopolymer or copolymer or a blend of at least two homopolymers or copolymers. If a polymer blend, at least one of the polymers contains basic groups to enhance dispersion of the acidic or neutral conductive particles. Basic polymers contain basic units, such as amine, imide or tertiary-amide groups. Typical polymers containing basic units include, for example, polyvinyl pyridine, polyvinyl pyrrolidone, polyimide, and the like. Any other suitable film forming polymer may be utilized in the semitransparent conductive coating. The polymers are also preferrably cross-linkable. Typical cross-linkable film forming polymers include, for example, poly methyl acrylamidoglycolate alkyl ether, poly(oxydiethylene maleate, N-phenyl maleimide-styrene copolymer, N-cyclohexyl maleimide-vinyl chloride copolymer and the like. Other typical film forming polymers include, for example, polystyrene, polycarbonate, polyester, methyl acrylamidoglycolate alkyl ether-vinyl acetate copolymer and the like.

The binder polymer cross-linking capability imparts enhanced chemical stability to the final dried coating. Cross-linking protects the dried conductive coating from being physically removed or attacked by subsequently applied solvents and ambient humidity, particularly when employed in composite devices. Migration of components of a conductive coating into subsequently applied layers can occur if an uncrosslinked binder polymer is dissolved by subsequently applied coating solvents. If such migration occurs, the conductive layer and other upper layers can be physically damaged and adversely affected electrically. For example, when used as a ground plane in photoreceptor devices, the mixing of the ground planes components with subsequently applied layers such as charge blocking and charge generator layers can cause low surface charging potentials and high residual voltages. The degree of cross-linking can be adjusted by varying the repeat unit ratio of the unit capable of cross-linking, the acid catalyst doping level, the heating time and heating temperature. Thus, for example, partial crosslinking can be achieved by heating the conductive layer at lower drying temperatures. The degree of crosslinking desired is determined by the adhesion and flexibility requirements of the complete devices. For example, partial crosslinking can provide an opportunity for further bonding to material in the next adjacent layer by heating the device with the adjacent layer at the temperature high enough for a condensation reaction to occur. This increases the adhesion between the conductive layer and the adjacent overlying layer.

Homopolymers and copolymers of methyl acrylamidoglycolate alkyl ether are especially preferred as binders because the polymers have the desired crosslinking capability. Copolymers of methyl acrylamidoglycolate alkyl ether and units with basic groups, such as N,N-dimethylacrylamine, N-vinylpyrrolidone, 2- and 4-vinylpyridine are especially preferred because the copolymers have the desired basic property and the preferred crosslinking capability for fabricating semitransparent conductive layers. Blends of these basic copolymers with other copolymers are also applicable for the conductive layer binders. Other copolymers preferrably comprise methyl acrylamidoglycolate alkyl ether and vinyl monomers. Polymers such as copolymers of methylacrylamidoglycolate alkyl ether will cross-link together upon heating. Typical copolymerizable vinyl monomers include acrylonitrile, methacrylonitrile, methylvinylether, and other alkyl and aryl vinyl ethers, styrene and substituted styrenes, ethylene, propylene, isobutylene, various methacrylate and acrylate esters and vinyl chloride, and the like. Other monomers, such as vinyl acetate and methylmethacrylate, can be copolymerized with methylacrylamido-glycolate alkyl ether in order to enhance adhesion or flexability. Some monomers that undergo vinyl like polymerizations that are not vinyl monomers may also copolymerize with methylacrylamido-glycolate alkyl ether.

Blends of copolymers or homopolymers containing imide or anhydride units with copolymers or homopolymers with hydroxy units or small diol molecules are also highly preferred because the imide or anhydride unites can be chemically bonded to the hydroxy units upon heating. Such a bonding can impart crosslink intergrity to the conductive layer. Typical copolymers or homopolymers with imide units include, for example, N-phenyl maleimide-styrene copolymer, N-cyclohexyl maleimide-vinyl chloride copolymer, N-phenyl maleimide-methyl methacrylate copolymer and the like. Typical copolymers with anhydride units include, for example, acrylol styrene-maleic anhydride copolymer, butyl vinylether-maleic anhydride copolymer, methyl methacrylate, maleic anhydride copolymer, and the like. Typical copolymers or homopolymers containing hydroxy units or small diol molecules include, for example, polyvinyl alcohol, polyvinyl butyral, bis-phenol-A, diethylene glycol and the like. The binder matrix can be crosslinked by heating the coating doped with or without an acid catalyst. If all the components in the conductive layer (prior to drying) are insoluble in the solvents utilized to apply coatings subsequent to the application of the counductive layer, cross-linking of the polymer in the conductive layer is merely optional.

The imide polymer that may be utilized in preparing the conductive layers of of this invention includes any suitable polymer containing maleimide functional groups. Typical maleimide polymer include, for example, N-phenyl maleimide-styrene copolymer, N-phenyl maleimide-methyl methacrate copolymer, N-phenyl maleimide-vinyl chloride copolymer, N-cyclohexyl maleimide-styrene copolymer, N-cyclohexyl maleimide-methyl methacrate copolymer, N-cyclohexyl maleimide-vinyl chloride copolymer, and the like.

The anhydride polymer that may be utilized in preparing the conductive layers of this invention includes any suitable polymers containing anhydride functional groups. Typical anhydride polymers include, for example, acrylol styrene-maleic anhydride copolymer, butyl vinylether-maleic anhydride copolymer, methyl methacrylate-maleic anhydride copolymer, and the like.

The hydroxy polymer that may be utilized in preparing the conductive layers of this invention includes any suitable polymer containing hydroxy functional groups. Typical hydroxy polymers include, for example, polyvinyl alcohol, polyvinyl butyral, and the like.

The diol molecule that may be utilized in preparing the conductive layers of photoreceptors of this invention includes any suitable small molecule with at least two hydroxyl functional groups. Typical diol molecules include, for example, ethylene glycol, diethylene glycol, 1,6-hexane diol and bis-phenol-A, and the like.

The alkyl acrylamidoglycolate alkyl ether utilized in preparing the backbone of a preferred polymer employed in the conductive layer of photoreceptors of this invention can be represented by the following formula:

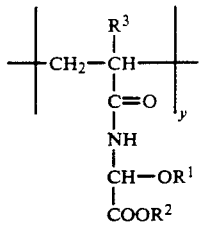

where $R^1$ and $R^2$ are independently selected from lower aliphatic groups containing from 1 to 10 carbon atoms and $R^3$ is hydrogen or a lower aliphatic groups containing from 1 to 10 carbon atoms.

Preferably, $R^1$ and $R^2$ contain from 1 to 4 carbon atoms with optimum results being achieved when $R^1$ and $R^2$ are methyl groups. Typical alkyl acrylamidoglycolate alkyl ethers include, for example, methyl acrylamidoglycolate methyl ether, butyl acrylamidoglycolate methyl ether, methyl acrylamidoglycolate butyl ether, butyl acrylamidoglycolate butyl ether, and the like.

A polymer derived from alkyl acrylamidoglycolate alkyl ether may be a homopolymer or a copolymer, the copolymer being a copolymer of two or more monomers. The alkyl acrylamidoglycolate alkyl ether monomer may be formed into a linear polymer by polymerization through the unsaturated bond. The monomers utilized to form a copolymer with the alkyl acrylamidoglycolate alkyl ether need not contain hydroxyl groups. Blends of the polymer with other miscible polymers may also be utilized. The blends should be compatible and be free of any separated phase having an average size of greater than about 10 micrometers. Test layers of the dried solid polymer blend are reasonably clear when any separated phase has an average size of less than about 10 micrometers.

Since a polymer for the conductive layer of this invention can be applied as an uncross-linked polymer dissolved in a solvent, it may be cross-linked in an oven without the aid of a catalyst and, therefore, can be free of any pot life problem or catalytic residue problem. When alkyl acrylamidoglycolate alkyl ether is used as a homopolymer, it may be cross-linked without the presence of any other materials. Cross-linking of this homopolymer may be achieved through the $R^1$ and $R^2$ groups. Satisfactory results may be achieved when the number average molecule weight for the linear homopolymer is at least about 2,000 if the polymer is eventually cross-linked. Preferably, the homopolymer has a number average molecular weight of at least 20,000 with optimum results being achieved with a number average molecular weight of at least about 50,000 prior to cross-linking. If the homopolymer is to remain a linear polymer in the final dried coating, satisfactory results may be achieved with a number average molecular weight of at least about 20,000. Preferably the number average molecular weight is at least about 50,000 and optimum results are achieved with a number average molecular weight of at least 100,000 if the polymer is to remain an uncross-linked linear polymer.

Up to 99 mole percent of any suitable vinyl monomer may be copolymerized with the alkyl acrylamidoglycolate alkyl ether monomer to form a polymer binder in the conductive layer of this invention. Typical vinyl monomers include, for example, vinyl chloride, vinyl acetate, styrene, acrylonitrile, N,N-dimethylacrylamide, 2-hydroxyethylacrylate, 2-hydroxyethylmethacrate, 2-hydroxypropylacrylate, 2-hydroxypropylmethacrylate, hydroxymethylacrylamide, hydroxymethylmethacrylamide, 2-vinylpyridene, 4-vinylpyridene, N-vinylpyrrolidone, methyl methacrylate, and the like.

The preferred alkyl acrylamidoglycolate alkyl ether is methylacrylamido-glycolate methyl ether which can be represented by the following formula:

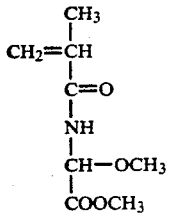

The methylacrylamido-glycolate methyl ether monomer is commercially available, for example, from American Cyanamid under the trademark MAGME. It is described in American Cyanamid Co. product brochure 4-211-3K as copolymerizable with various other vinyl type monomers. It is also indicated in the brochure that the most likely cross-linking chemical pathways are a function of heating and/or acid catalysis with heating. Methyl acrylamidoglycolate methyl ether monomer is a multi-functional acrylic monomer which, after undergoing a standard vinyl polymerization by itself or with other vinyl monomers to form a linear polymer, provides chemically reactive sites that can be cross-linked by several chemical routes. Cross-linking of the alkyl acrylamidoglycolate alkyl ether homopolymer may be achieved through the $R^1$ and $R^2$ groups. The alkyl ester and alkyl ether reactive sites in the alkyl acrylamidoglycolate alkyl ether repeat units of alkyl acrylamidoglycolate alkyl ether containing polymers can also be reacted with difunctional nucleophiles such as diamines, dialcohols, or bis phenols to give a covalently cross-linked polymer network. Such a cross-linked binder can encapsulate and permanently anchor conductive particles such as carbon black. Subsequently applied coating compositions in various solvents or solvent combinations are incapable of dislodging these particles. Deleterious electrical effects (low charge acceptance, high dark decay and high residual voltage) usually caused by migration of conductive particles are minimized by preventing the upward migration of conductive particles into other layers of the photoreceptor. In all these nucleophilic displacement reactions on alkyl acrylamidoglycolate alkyl ether repeat units in alkyl acrylamidoglycolate alkyl ether containing polymers, an alkanol is evolved. Volatile alcohol by-products such as methanol from methylacrylamido-glycolate methyl ether repeat units are evolved and leave the coating because the reactions are carried out at about 135° C., well over the boiling point (65° C.) of methanol.

A preferred vinyl monomer copolymerizable with the alkyl acrylamidoglycolate alkyl ether is a vinyl hydroxy ester or vinyl hydroxy amide having the following structure:

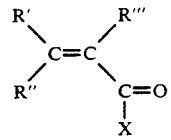

wherein

X is selected from the group consisting of:

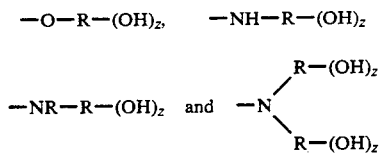

R is a divalent group selected from the group consisting of aliphatic, aromatic, heteroaliphatic, heteroaromatic, fused aromatic ring and heteroaromatic ring groups containing up to 10 carbon atoms;

z is 1 to 10; and

R′, R″ and R‴ are are monovalent groups independently selected from the group consisting of hydrogen, lower aliphatic containing to 10 carbon atoms and aromatic, heteroaliphatic, heteroaromatic, fused aromatic ring and heteroaromatic ring groups containing up to 10 carbon atoms.

Typical divalent R aliphatic groups include methylene, ethylidene, propylidene, isopropylidene, butylene, isobutylene, decamethylene, phenylene, biphenylene, piperadinylene, tetrahydrofuranylene, pyranylene, piperazinylene, pyridylene, bipyridylene, pyridazinylene, pyrimidinylene, naphthylidene, quinolinyldene, cyclohexylene, cyclopentylene, cyclobutylene, cycloheptylene, and the like.

Typical monovalent R', R'' and R''' groups include hydrogen, methyl, ethyl, propyl, isopropyl, butyl, isobutyl, decyl, phenyl, biphenyl, piperadinyl, tetrahydrofuranyl, pyranyl, piperazinyl, pyridyl, bipyridyl, pyridazinyl, naphthyl, quinolinyl, cyclohexyl, cyclopentyl, cyclobutyl, cycloheptyl, and the like.

Typical aliphatic, aromatic, heteroaliphatic, heteroaromatic, fused aromatic ring and heteroaromatic ring groups containing up to 10 carbon atoms include linear, single ring and multiple ring, fused and unfused groups such as napthalene, thioprene, quinoline, pyridine, toluene, furan, pyrrole, isoquinoline, benzene, pyrazine, pyrimidine, bipyridine, pyridazine, and the like.

The copolymer having a backbone derived from alkyl acrylamidoglycolate alkyl ether may be a copolymer of 2 or more different monomers or polymer blocks. Copolymers of alkyl acrylamidoglycolate alkyl ether and vinyl hydroxy ester or vinyl hydroxy amide monomers are particularly preferred because they are non-ionic and neutral and chemically innocuous and do not adversely affect the electrically properties of the photoreceptor. If desired, the copolymer of alkyl acrylamidoglycolate alkyl ether monomer and vinyl hydroxy ester or vinyl hydroxy amide monomer may also be co-reacted with any other suitable reactive monomer. More basic solvent, either through quantity or basicity, can be used in order to impart sufficient basicity to the polymer solution. If desired, the copolymer of alkyl acrylamidoglycolate alkyl ether monomer and vinyl hydroxy ester or vinyl hydroxy amide monomer may also be co-reacted with any other suitable reactive monomer.

Examples of preferred embodiments of vinyl hydroxy ester and vinyl hydroxy amide monomers having the above structure include those having the following structure:

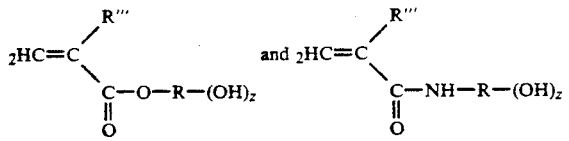

wherein:

R is a lower aliphatic group containing from 1 to 5 carbon atoms,

R''' is $CH_3$ or hydrogen, and z is 1 to 5.

Optimum results are achieved with monomers having the above structure include those having the following structure:

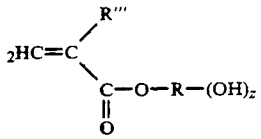

wherein:

R is a lower aliphatic group containing from 2 to 3 carbon atoms,

R''' is $CH_3$ or hydrogen, and z is 1 or 2.

Typical vinyl hydroxy esters and vinyl hydroxy amides include 4-hydroxybutylmethacrylate, 4-hydroxybutylacrylate, 3-hydroxypropylmethacrylate, 3-hydroxypropylacrylate, 2,3-dihydroxypropylmethacrylate, 2,3,4-trihydroxybutylmethacrylate, 2,3,4-trihydroxybutylacrylate, N-2,3 dihydroxypropylmethacrylamide, N-2,3 dihydroxypropylacrylamide, N-hydroxymethylmethacrylamide, N-hydroxymethylacrylamide, N-2-hydroxyethylmethacrylamide, N-2-hydroxyethylacrylamide, 4-hydroxyphenylmethacrylate, 4-hydroxyphenylacrylate, 3-hydroxyphenylmethacrylate, 3-hydroxyphenylacrylate, N-3 or 4-hydroxyphenylmethacrylamide, N-3 or 4-hydroxyphenylacrylamide, 4(2-hydroxypyridyl)methacrylate, 4(2-hydroxypyridyl)acrylate, 4(3-hydroxypiperidinyl)methacrylate, 4(3-hydroxypiperidinyl)acrylate, N-4(2-hydroxypyridyl)-methacrylamide, N-4(2-hydroxypyridyl)acrylamide, N-4(3-hydroxypiperindinyl)methacrylamide, N-4(3-hydroxypiperindinyl)acrylamide, [1(5-hydroxynaphthyl]methacrylate, [1(5-hydroxynaphthyl]acrylate, N-1(5-hydroxyethylnaphthyl)methacrylamide, N-1(5-hydroxyethylnaphthyl)acrylamide, 1(4-hydroxycyclohexyl)methacrylate, 1(4-hydroxycyclohexyl)acrylate, pN-1(3-hydroxycyclohexyl)methacrylamide, N-1(3-hydroxycyclohexyl)acrylamide, and the like. These vinyl hydroxy ester or vinyl hydroxy amide monomers can be copolymerized with alkyl acrylamidoglycolate alkyl ether to yield random or block copolymer compositions having a high degree of purity without electrically deleterious catalyst and/or monomer residuals, and at very high weight average molecular weights (e.g. ≧100,000).

The copolymer having a backbone derived from alkyl acrylamidoglycolate alkyl ether and a vinyl hydroxy ester or vinyl hydroxy amide may be a copolymer, a terpolymer or the the like. Moreover, the copolymer may be a random copolymer or a block copolymer. A preferred copolymer in linear form prior to cross-linking is represented by the following formula:

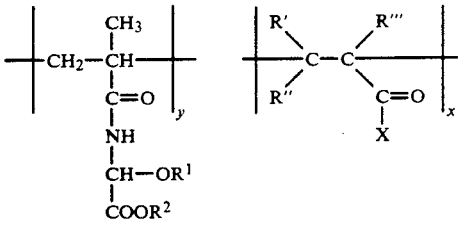

wherein:

$R^1$ and $R^2$ are independently selected from alkyl groups containing from 1 to 4 carbon atoms, y is from 100 mol percent to 1 mol percent, x is from 0 mol percent to 99 mol percent, X is selected from the group consisting of groups represented by the following groups:

$-O-R-(OH)_z$, $-NH-R-(OH)_z$,

-continued

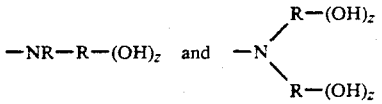

R is selected from the group consisting of aliphatic, aromatic, heteroaliphatic, heteroaromatic, fused aromatic ring and heteroaromatic ring groups containing up to 10 carbon atoms;

z contains from 1 to 10 hydroxyl groups;

R', R'' and R''' are independently selected from the group consisting of hydrogen, aliphatic, aromatic, heteroaliphatic, heteroaromatic, fused aromatic ring and heteroaromatic ring groups containing up to 10 carbon atoms.

Generally, satisfactory results may be achieved when x is between about 0 and about 99 mol percent and y is between about 100 and about 1 mol percent. Preferably y is between about 33 and about 90 mol percent and x between about 67 and about 10 mol percent. Optimum results are achieved when y is between about 33 and about 67 mol percent and x is between about 67 and about 32 mol percent. If desired, the alkyl acrylamidoglycolate alkyl ether of this invention may be employed as a homopolymer instead of a copolymer. This homopolymer may be cross-linked without the presence of any other materials.

Satisfactory results may be achieved when the number average molecular weight for the linear homopolymer or copolymer is at least about 2,000 if the polymer is eventually cross-linked in the deposited coating. Preferably, the homopolymer or copolymer has a number average molecular weight of at least 20,000 with optimum results being achieved with a number average molecular weight of at least about 50,000 prior to cross-linking. The upper limit for number average molecular weight appears to be limited only by the viscosity necessary for processing.

If the homopolymer or copolymer is to remain a linear polymer in the final dried conductive layer coating, satisfactory results may be achieved with a number average molecular weight of at least about 10,000. Preferably the number average molecular weight should be at least about 20,000 and optimum results may be achieved with a number average molecular weight of at least 50,000 if the polymer is to remain an uncross-linked linear polymer.

Other typical copolymers having a backbone derived from methyl acrylamidoglycolate methyl ether (MAGME) and 2-hydroxyethylmethacrylate (HEMA) are represented by the following formula:

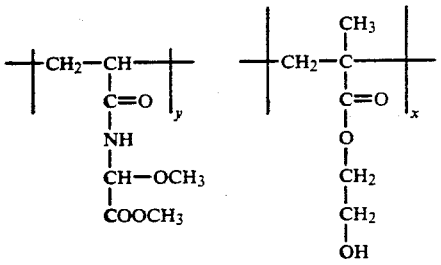

wherein:

y is from 100 mol percent to 1 mol percent and x is from 0 mol percent to 99 mol percent.

Another preferred polymer is one having a backbone derived from methyl acrylamidoglycolate methyl ether and 2-hydroxypropylmethacrylate (HPMA) represented by the following formula:

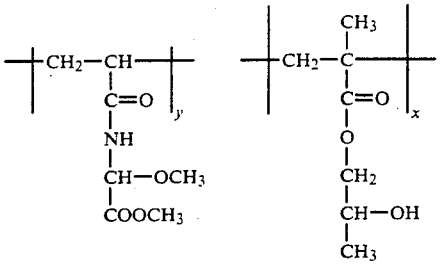

wherein:

y is from 100 mol percent to 1 mol percent and x is from 0 mol percent to 99 mol percent.

Still another preferred polymer is one having a backbone derived from methyl acrylamidoglycolate alkyl ether and 2-hydroxyethylacrylate (HEA) which is represented by the following formula:

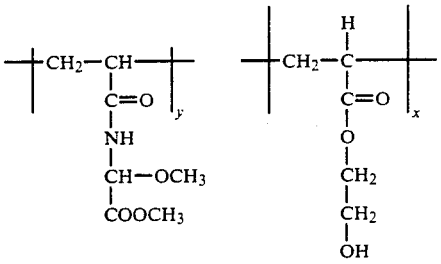

wherein:

y is from 100 mol percent to 1 mol percent and x is from 0 mol percent to 99 mol percent.

Still another preferred polymer is one having a backbone derived from methyl acrylamidoglycolate methyl ether and 2-hydroxypropylacrylate which is represented by the following formula:

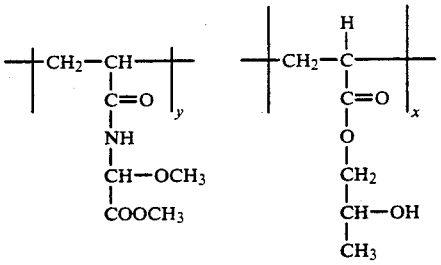

wherein:

y is from 100 mol percent to 1 mol percent and x is from 0 mol percent to 99 mol percent.

Compounds that may be employed in the conductive layer of this invention also include film forming copolymers of the above compounds with one or more copolymerizable vinyl or other suitable monomers. Typical copolymerizable vinyl monomers include acrylonitrile, methacrylonitrile, methylvinylether, and other alkyl and aryl vinyl ethers, styrene and substituted styrenes, ethylene, propylene, isobutylene, vinyl acetate, various methacrylate and acrylate esters and vinyl chloride, and the like. Some monomers that undergo vinyl like polymerizations that are not vinyl monomers may also copolymerize with alkyl acrylamidoglycolate alkyl ether and these hydroxy ester or hydroxy amide vinyl monomers. These include, for example, butadiene, isoprene, chloroprene, other conjugated diene monomers and the like.

The polymers for the conductive layer of this invention may be blended with other suitable and compatible polymers. Compatible polymers are miscible with the polymers derived from alkyl acrylamidoglycolate alkyl ethers and the other monomers described above. The coating after drying should be substantially clear with any phase separated domain having an average size of less than about 10 micrometers.

These types of compatible blends are blends in which no common repeat unit exists in the blended polymers and compatibility is achieved through extensive hydrogen bonding. This type of compatible blend can be formed with alkyl acrylamidoglycolate alkyl ether containing polymers and involve strong hydrogen bonding acceptor repeat units in the second polymer. The latter are not strongly basic and include repeat units of ethyloxazoline vinylpyrrolidone, N,N-dimethylacrylamide and any other tertiary amide containing repeat units. The first polymer to be blended frequently contains alkyl acrylamidoglycolate alkyl ether repeat units and hydroxy ester (or amide) repeat units capable of hydrogen bonding through the hydroxyl group, to the tertiary amide sites of the slight basic hydrogen bonding acceptor repeat units of the second polymer to be blended. This hydrogen bonding maintains sufficient compatibility between the blended polymers with or without subsequent thermal cross-linking of the alkyl acrylamidoglycolate alkyl ether repeat units. A preferred compositional blend comprises, as one component, a copolymer containing repeat units of methyl acrylamidoglycolate methyl ether (MAGME) and vinyl pyrrolidone (VP) or 2- or 4-vinyl pyridine (VPy) wherein the MAGME repeat unit content is between about 33 and about 63 mole percent and the hydroxyester repeat unit content is between about 37 and about 67 mole percent and, as a second component, poly(ethyloxazoline) P(EOx) homopolymer. Poly(ethyloxazoline) may be represented by the following formula:

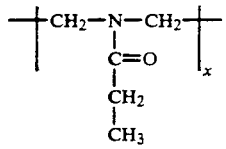

wherein X is a number from 300 to 20,000.

For the preferred blends with poly(ethyloxazoline) described above, the weight percent of each blended polymer is used to define blend composition. For conductive layer layer photoreceptor applications, the alkyl acrylamidoglycolate alkyl ether containing polymer will dominate the blend composition versus P(EOx) because only the former can be cross-linked (to itself). Consequently the P(EOx), although somewhat constrained by hydrogen bonding to the hydroxyl groups of the cross-linked HEMA-MAGME or HEA-MAGME and by the three dimensional (cross-linked) network itself, can still migrate into subsequently coated layers during solvent coating thereof. Although blends containing equal weights of P(EOx) with HEMA-MAGME or HEA-MAGME copolymers are compatible, these blends are generally not desirable in photoreceptor applications because of the large amounts of P(EOx) may migrate into other layers causing deficiencies in cyclic electrical properties. Satisfactory conductive layer blend compositions are obtained when about ≦30 weight percent of the blend is P(EOx) and the preferred compositions contain about ≦20 weight percent P(EOx) whereas the optimum compositions contain about ≦10 weight percent P(EOx). The remainder of these blend compositions comprise the alkyl acrylamidoglycolate alkyl ether containing polymer. When the alkyl acrylamidoglycolate alkyl ether containing polymer and the second blendable copolymer [not P(EOx) or P(yoaX-VP)] can be covalently cross-linked to each other during routine oven drying of the wet coating, then polymer migration from such a conductive layer cannot occur during solvent coating subsequent photoreceptor layers. Consequently, there then exists no limits as to the weight percent of each polymer that can be used in the blend. For uncross-linked photoreceptor applications, the total amount of MAGME and other solubilizing repeat units derived from N,N-dimethylacrylamide (DMA), vinyl acetate (VOAc) and N-vinylpyrrolidone (VP) should be kept at a minimum (≦40±5 mole percent) to prevent macromolecular migration during subsequent coating steps. At least partial cross-linking of photoreceptor conductive layers is preferred for most conductive layers to enhance solvent barrier properties.

Typical examples of compatible blend coatings from a coating solvent capable of dissolving equal weights of the two copolymers to be blended include the following. The indicated compositional values are mole percent repeat units.

| Polymer 1 | Compositions | Polymer 2 | Composition |
|---|---|---|---|
| P(MAGME-VP) | 50-50 | P(HEMA-DMA) | 67-33 |
| P(DMA-MAGME) | 43-57 | P(HEA-HPMA) | 50-50 |
| P(DMA-MAGME) | 43-57 | P(HPMA) | 100 |
| P(DMA-MAGME) | 43-57 | P(VOAc-VP)* | 50-50 |
| P(DMA-MAGME) | 43-57 | P(VOAc-VP)* | 50-50 |
| P(DMA-MAGME) | 43-57 | P(HEMA-VP) | 80-20 |
| P(MAGME-VP) | 33-67 or 50-50 | P(HEMA) | 100 |

The monomer abbreviations in the above table are as follows:

HEMA—2-hydroxyethyl methacrylate
MAGME—methyl acrylamidoglycolate methyl ether
DMA—N,N-dimethylacrylamide
VOAc—vinyl acetate
VP—N-vinylpyrrolidone
EOx—ethyl oxazoline The backbone derived from alkyl acrylamidoglycolate alkyl ether is always cross-linked or partially cross-linked in the ground plane layer if it is coated with a coating solution containing the same polymer or a solvent which attacks an uncross-linked polymer derived from methylacrylamidoglycolate alkyl ether. The maleimide or anhydride polymer and the hydroxy polymer are always cross-linked or partially cross-linked together in the ground plane layer. If the blocking layer also contains a polymer derived from alkyl acrylamidoglycolate alkyl ether, the blocking layer polymer may be either uncross-linked (i.e. linear), partially crosslinked or cross-linked in the dried blocking layer. A cross-linked or partially cross-linked polymer is utilized in the ground plane layer under these circumstances because conductive particles such as carbon black are permanently encapsulated thereby preventing migration of the conductive particles into layers above during coating thereof. If migration were to be permited, it would cause lower charge acceptance and possible $V_R$ cycle-up so it is desirable to avoid such conductive particle migration. Cross-linking may be effected by merely applying heat with or without the presence of an acid during the drying step after the homopolymer or copolymer is applied as a coating from a solvent solution. The degree of cross-linking with or without acid dopping may be adjusted by the heating temperature. Cross-linking of the methyl acrylamidoglycolate methyl ether homopolymer may be achieved through the $R^1$ and $R^2$ groups. When hydroxy repeat units derived from such as vinyl hydroxy ester or vinyl hydroxy amide are reacted with the alkyl acrylamidoglycolate alkyl ether, covalent cross-linking may be achieved by displacement of the alkoxy and the lower aliphatic carboxy group. Limited or partial cross-linking of alkyl acrylamidoglycolate alkyl ether repeat units in the conductive layer is desirable for above reason and also because the remaining uncross-linked alkyl acrylamidoglycolate alkyl ether repeat units on the conductive layer surface remain available to react with vinyl hydroxy ester or vinyl hydroxy amide hydroxyl groups and/or alkyl acrylamidoglycolate alkyl ether units in the blocking layer. This is desirable because it enables chemical reactions to occur to form covalent bonds with any coreactant in the blocking layer across the conductive layer-blocking layer interface thereby improving adhesion between these two layers. Crosslinking of the maleimide or anhydride polymer and hydroxy polymer (or diol molecule) can also be achieved by ring opening of the maleimide through heating, as shown below:

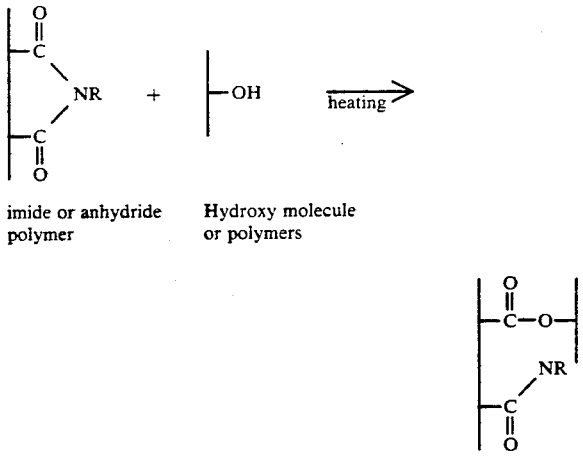

The degree of crosslinking can be controlled by varying the number of maleimide and hydroxy units (or the diol molecule loading) or the heating time and temperature. Cross-linking of the polymer in the conductive layer does not impact conductivity. Thus, for example, thick (e.g. 8–10 micrometer) carbon black loaded (e.g. 15 weight percent) conductive layers are bulk conductive giving four point test probe resistivities of $10^3$–$10^4$ ohms/square at all ambient humidities. Since cross-linking of the copolymer in any conductive layer employed creates a more solvent resistant barrier layer to subsequently applied coating compositions. Thus, cross-linked polymers in conductive layers are preferred.

Generally, in the absence of an acid dopant, the solvent will be driven off and the polymer in the conductive coating remaining will be uncross-linked if the drying temperature is maintained at less than about 90° C. At drying temperatures greater than about 120° C., the polymer coating remaining will be mostly-cross-linked. At temperatures of between about 90° C. and about 120° C. copolymers that contain both an alkyl acrylamidoglycolate alkyl ether repeat unit and a hydroxy containing repeat unit are likely to be partially cross-linked. Because these polymers can be easily cross-linked during routine drying of photoreceptor coatings, this method of cross-linking is extremely convenient (no extra drying step or extra cross-linking materials or catalysts) in fabricating photoreceptor layers by any fabrication method involving an oven drying step.

Cross-linking between substantially identical copolymer chains can occur by two chemical routes. Methyl acrylamidoglycolate methyl ether units in one copolymer chain can self condense with methyl acrylamidoglycolate methyl ether units in a second polymer chain to give a complex methylene bis amide cross-link illustrated below:

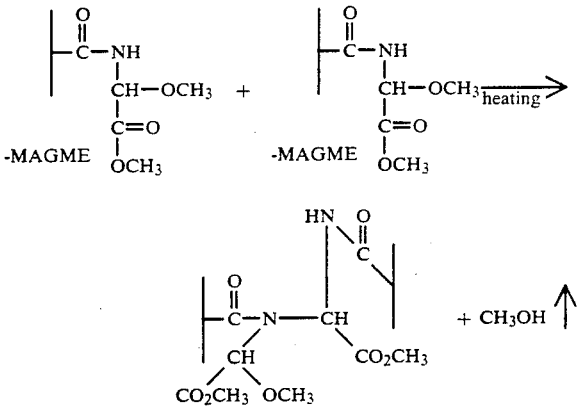

This cross-linking pathway is believed to be a minor pathway because this chemical reaction takes place slowly at 135° C. in the absence of an acid catalysis. However, when acid catalysis is employed, this pathway becomes more important. Since migration of the small molecule acid species (p-toluenesulfonic acid) into other layers (during coating thereof) can cause deleterious electrical effects, cross-linking of these conductive layers without acid catalysis is preferred with cross-linking being accomplished by merely applying heat while simultaneously removing the coating solvent in, for example, an air convection oven. Thus, the chemical reaction depicted above remains a minor cross-linking pathway, leaving the bulk of the methylacrylamidoglycolate methyl ether repeat units available to participate in the second cross-linking pathway which is less dependent on acid catalysis at 135° C.

The second cross-linking pathway is shown below:

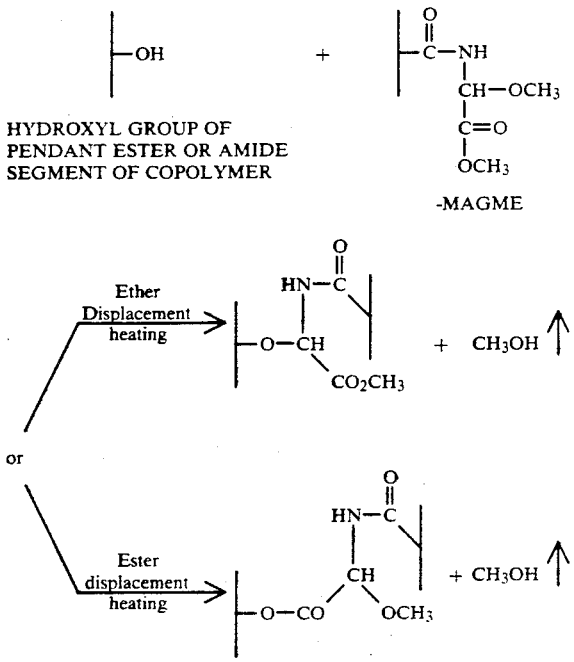

In this second cross-linking pathway, hydroxyl groups from one copolymer displace both the ether and ester methoxyl groups of another copolymer to give the corresponding ether and ester cross-links. This reaction proceeds rapidly at 135° C. even without acid catalysis.

For conductive layers, the polymer should be sufficiently cross-linked to ensure substantial insolubility in solvents employed to apply the blocking or other subsequently applied layer. Substantial insolubility can be determined by gently rubbing the dried conductive coating with Q-tips wetted with the solvents which normally dissolve the coating binders in an uncross-linked condition. The degree of crosslinking can be determined by how strongly the colors of dispersed conductive particles, for example "blackness" for the case of carbon black loaded coatings, are visible on the Q-tips.

The binder matrix of the dried conductive layer of this invention is charge transporting and thereby, ensures sufficient transfer of charges between conducting particles. This property is particularly important when, in many cases, at high humidity the polymer binder swells by absorbing water and inhibits charge transport between the conducting particles. A charge transporting matrix ensures charge transporting between conducting particles regardless of the humidity conditions. The charge transporting polymer matrix can be prepared by using either charge transporting polymers or polymers doped with charge transporting small molecules. Hole transporting polymers or small molecules are employed for p-type conducting particles whereas electron transporting polymers or small molecules are utilized for n-type conducting particles. The small molecule charge transport dopants are preferably bonded to the polymeric binder by either strong hydrogen bonding or covalent bonding to prevent removal from the conductive coatings and migration into the upper layers. If migration were to occur, the conductive layer cannot maintain its resistivity at different humidities and photoreceptor devices containing the conductive layer will not hold the surface charges well. Thus, the polymer itself may possess charge transporting capabilities or it may contain a dissolved or molecularly dispersed charge transport small molecule to maintain its resistivity at different humidities. Satisfactory improvement at high humidity conditions is achieved when the loading level of the charge transporting small molecule is at least about 5 weight percent of the total binder weight (sum of the small molecules and polymers), but more preferrably is between about 15 and about 40 weight percent of the total binder weight. The preferred weight ratio is generally the minimum amount of charge transporting small molecules over 5 weight percent of the total binder weight needed to minimize the effect of humidity on the resisitivity value of the conductive layer. Loading levels greatly exceeding than the minimum amount are less preferred, because the dispersion viscosity can become too low to achieve the desired conductive coating thickness.

If no charge transporting small molecules are doped into the polymer binder, at least one of the copolymers in the blend is preferably charge transporting, e.g. copolymers of MAGME-vinyl carbazole, maleic anhydride-vinyl carbazole or maleimide-vinyl carbozole. If hydroxyl group containing charge transporting molecules are added as a dopant, one of the binder polymers may contain anhydride, imide or epoxy groups which can crosslink to the hydroxyl groups of the charge transporting molecules by a ring opening reaction. The ring opening reaction involving an anhydride or imide group containing polymer and a molecule containing a hydroxyl group is shown below:

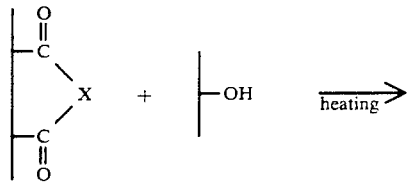

Anhydride or imide polymer

Hydroxy molecule or polymer

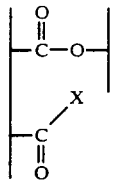

The ring opening reaction involving an epoxy group containing polymer and a molecule polymer containing a hydroxyl group is illustrated below:

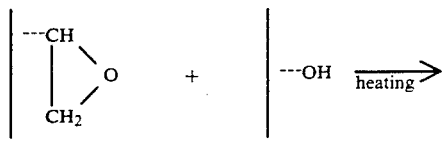

Epoxy group containing polymer

Hydroxy molecule

-continued

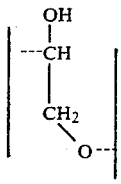

Any suitable film forming polymer having charge transport capabilities may be used as a binder in the continuous phase of the conductive matrix of the conductive layer of this invention. Binders having charge transport capabilities are substantially nonabsorbing in the spectral region of intended use, but are "active" in that they are capable of transporting charge carriers injected by the conductive particles in an applied electric field. Charge transporting film forming polymers are well known in the art. A partial listing representative of such charge transporting film forming polymers includes the following:

Polyvinylcarbazole and derivatives of Lewis acids described in U.S. Pat. No. 4,302,521. Vinyl-aromatic polymers such as polyvinyl anthracene, polyacenaphthylene; formaldehyde condensation products with various aromatics such as condensates of formaldehyde and 3-bromopyrene; 2,4,7-trinitrofluoreoene, and 3,6-dinitro-N-t-butylnaphthalimide as described in U.S. Pat. No. 3,972,717. Other transport materials such as poly-1-vinylpyrene, poly-9-vinylanthracene, poly-9-(4-pentenyl)-carbazole, poly-9-(5-hexyl)-carbazole, polymethylene pyrene, poly-1-(pyrenyl)-butadiene, polymers such as alkyl, nitro, amino, halogen, and hydroxy substitute polymers such as poly-3-amino carbazole, 1,3-dibromo-poly-N-vinyl carbazole and 3,6-dibromo-poly-N-vinyl carbazole and numerous other transparent organic polymeric transport materials as described in U.S. Pat. No. 3,870,516. Polycarbonate transport polymers such as poly[N,N'-diphenyl-N,N'-bis-(3-hydroxyphenyl)-[1,1-biphenyl]-4,4'-diamine]carbonate, polyhydroxyether resins based on N,N'-diphenyl-N,N'-bis(4-hydroxyphenyl)-[1,1'-biphenyl]-4,4'-diamine and N,N'-diphenyl-N,N'-bis(4-2,3-epoxypropoxy)-phenyl)[1,1'-biphenyl]-4,4'-diamine described, for example, in U.S. Pat. Nos. 4,806,443, 4,806,444, 4,418,650, or 4,818,650. The disclosures of each of the patents and pending patent application identified above pertaining to binders having charge transport capabilities are incorporated herein in their entirety. Copolymers of MAGME and polymers with charge transporting groups, such as vinyl carbazole-like groups are the preferred charge transporting binder polymers because the copolymer is compatible with and can be crosslinked to other MAGME homopolymers or copolymers used as the binder in the conductive coatings. These types of copolymers can be synthesized by the thermal induced radical initiated reaction of vinyl carbazole and MAGME monomer. Copolymers of maleic anhydride-vinyl carbazole or maleimidevinyl carbozole are also preferable because the he copolymer is compatible with other maleic anhydride and maleimide copolymers and can be crosslinked to other diol polymers or molecules. The film forming binder should should be capable of forming a continuous film and be substantially transparent to activating radiation to which the underlying photoconductive layer is sensitive. In other words, the transmitted activating radiation should be capable of generating charge carriers, i.e. electron-hole pairs in the underlying photoconductive layer or layers.

Any suitable charge transport molecule capable of acting as a film forming binder or which is soluble or dispersible on a molecular scale in a film forming binder may be utilized in the continuous binder matrix of the conductive layer of this invention. A partial listing representative of non film forming charge transporting materials include the following:

Aromatic diamine charge transport molecules of the types described in U.S. Pat. Nos. 4,306,008, 4,304,829, 4,233,384, 4,115,116, 4,299,897, 4,265,990 and 4,081,274. Typical diamine transport molecules include N,N'-diphenyl-N,N'-bis(alkylphenyl)-[1,1'-biphenyl]-4,4'-diamine wherein the alkyl is, for example, methyl, ethyl, propyl, n-butyl, etc. such as N,N'-diphenyl-N,N'-bis(3''-methylphenyl)-[1,1'-biphenyl]-4,4'-diamine, N,N'-diphenyl-N,N'-bis(4-methylphenyl)-[1,1'-biphenyl]-4,4'-diamine, N,N'-diphenyl-N,N'-bis(2-methylphenyl)-[1,1'-biphenyl]-4,4'-diamine, N,N'-diphenyl-N,N'-bis(3-ethylphenyl)-[1,1'-biphenyl]-4,4'-diamine, N,N'-diphenyl-N,N'-bis(4-ethylphenyl)-[1,1'-biphenyl]-4,4'-diamine, N,N'-diphenyl-N,N'-bis(4-n-butylphenyl)-[1,1'-biphenyl]-4,4'-diamine, N,N'-diphenyl-N,N'-bis(3-chlorophenyl)-[1,1'-biphenyl]-4,4'-diamine, N,N'-diphenyl-N,N'-bis(4-chlorophenyl)-[1,1'-biphenyl]-4,4'-diamine, N,N'-diphenyl-N,N'-bis(phenylmethyl)-[1,1'-biphenyl]-4,4'-diamine, N,N,N',N'-tetraphenyl-[2,2'-dimethyl-1,1'-biphenyl]-4,4'-diamine, N,N,N',N'-tetra(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, and the like. Pyrazoline transport molecules as disclosed in U.S. Pat. Nos. 4,315,982, 4,278,746, 3,837,851. Typical pyrazoline transport molecules include 1-[lepidyl-(2)]-3-(p-diethylaminophenyl)-5-(p-diethylaminophenyl)pyrazoline, 1-[quinolyl-(2)]-3-(p-diethylaminophenyl)-5-(p-diethylaminophenyl)-pyrazoline, 1-[pyridyl-(2)]-3-(p-diethylaminostyryl)-5-(p-diethylaminophenyl)pyrazoline, 1-[6-methoxypyridyl-(2)]-3-(p-diethylaminostyryl)-5-(p-diethylaminophenyl)pyrazoline, 1-phenyl-3-[p-dimethylaminostyryl]-5-(p-dimethylaminostyryl)pyrazoline, 1-phenyl-3-[p-diethylaminostyryl]-5-(p-diethylaminostyryl)-pyrazoline, and the like. Substituted fluorene charge transport molecules as described in U.S. Pat. No. 4,245,021. Typical fluorene charge transport molecules include 9-(4'-dimethylaminobenzylidene)fluorene, 9-(4'-methoxybenzylidene)fluorene, 9-(2',4'-dimethoxybenzylidene)fluorene, 2-nitro-9-benzylidene-fluorene, 2-nitro-9-(4'-diethylaminobenzylidene)fluorene and the like. Oxadiazole transport molecules such as 2,5-bis(4-diethylaminophenyl)-1,3,4-oxadiazole, pyrazoline, imidazole, triazole, and others described in German Pat. Nos. 1,058,836, 1,060,260 and 1,120,875 and U.S. Pat. No. 3,895,944. Typical examples of hydrazone transport molecules include p-diethylaminobenzaldehyde-(diphenylhydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde-(diphenylhydrazone), p-dipropylaminobenzaldehyde-(diphenylhydrazone), p-diethylaminobenzaldehyde-(benzylphenylhydrazone), p-dibutylaminobenzaldehyde-(diphenylhydrazone), p-dimethylaminobenzaldehyde-(diphenylhydrazone) and the like described, for example in U.S. Pat. No. 4,150,987. Other hydrazone transport molecules include compounds such as 1-naphthalenecarbaldehyde 1-methyl-1-phenylhydrazone, 1-naphthalenecarbaldehyde 1,1-phenylhydrazone, 4-methoxynaphthlene-1-carbaldehyde 1-methyl-1-phenylhydrazone and still other hydrazone transport molecules are described, for example, in U.S. Pat. Nos. 4,385,106, 4,338,388, 4,387,147, 4,399,208, 4,399,207. Another charge transport molecule is a carbazole phenyl hydrazone such as 9-methylcarbazole-3-carbaldehyde-1,1-diphenylhydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and other suitable carbazole phenyl hydrazone transport molecules described, for example, in U.S. Pat. No. 4,256,821. Similar hydrazone transport molecules are described, for example, in U.S. Pat. No. 4,297,426. Typical 9-fluorenylidene methane charge transporting derivatives include (4-n-butoxycarbonyl-9-fluorenylidene)malonontrile, (4-phenethoxycarbonyl-9-fluorenylidene)malonontrile, (4-carbitoxy-9-fluorenylidene)malonontrile, (4-n-butoxycarbonyl-2,7-dinitro-9-fluorenylidene)malonate, and the like. Other typical transport materials include the numerous transparent organic non-polymeric transport materials described in U.S. Pat. No. 3,870,516 and the nonionic compounds described in U.S. Pat. No. 4,346,157. The disclosures of each of the patents identified above pertaining to charge transport molecule which are soluble or dispersible on a molecular scale in a film forming binder are incorporated herein in their entirety. Other transport material such as poly-1-vinylpyrene, poly-9-vinylanthracene, poly-9-(4-pentenyl)-carbazole, poly-9-(5-hexyl)-carbazole, polymethylene pyrene, poly-1-(pyrenyl)-butadiene, polymers such as alkyl, nitro, amino, halogen, and hydroxy substitute polymers such as poly-3-amino carbazole, 1,3-dibromo-poly-N-vinyl carbazole and 3,6-dibromo-poly-N-vinyl carbazole and numerous other transparent organic polymeric or non-polymeric transport materials are described in U.S. Pat. No. 3,870,516. Still other charge transporting small molecules include hydrazone type molecules with diamines, dialcohols or bisphenols type difunctional nucleophiles and the like. Charge transporting small molecules containing two or more hydroxyl functional groups, such as N,N'-bis(3''hydroxyphenyl)-[1,1'biphenyl]-4,4''diamine), will cross-link upon heating with MAGME, maleimide or anhydride units rapidly without acid catalyst. This ring opening reaction involving an maleimide or anhydride group containing polymer and a molecule containing a hydroxyl group was previously shown above. The methyl ester and methyl ether reactive sites in the MAGME repeat units of MAGME containing polymers can be reacted with difunctional nucleophiles such as diamines, dialcohols, or bis phenols to give a covalently crosslinked polymer network. If a monofunctional nucleophile is used to react with MAGME units in MAGME containing polymers or if only one of the nucleophilic sites in a difunctional nucleophile reacts with some MAGME units in MAGME, available, then the reacting nucleophilic containing molecule covalently binds to one MAGME repeat unit. In this case, a cross-link does not form because only one end of the nucleophile is attached to one polymer chain; such an attachment is called polymer modification which simply means that the MAGME repeat unit has been chemically modified by the covalent attachment of the nucleophilic modifier molecule. In addition, the activation energy of these nucleophilic displacement cross-linking reactions can be reduced by increasing the nucleophillicity of the phenol groups. This is accomplished by complexing the phenolic OH group with the slightly basic sites in the polymer (such as vinyl pyrrolidone). A slightly basic solvent component could also provide some basic catalysis in the same way provided that it does not volatilize at the heating temperature prior to participation as a catalyst.

In general, a low concentration of charge transport units (for example, vinylcarbazole) in polymers or a low loading of small molecules is adequate for the required charge transporting purpose. The specific amount of charge transport molecule which is used may vary depending upon the particular charge transport material and its compatibility (e.g. solubility in the continuous insulating film forming binder phase of the conductive layer) and the like. A satisfactory range is between about 5 percent and about 40 percent by weight of the small molecule or charge transport unit based on the total weight of the binder matrix.

Any suitable solvent may be employed in the solution used to form the conductive coating. Also, any suitable solvent may be employed in the preferred basic solution used to form the semi-transparent conductive coating. As indicated previously, the preferred basic solution may contain a basic polymer, a basic solvent or a combination of a basic polymer and a basic solvent. Typical basic solvents include, for example, dimethyl aminoethanol, tetrahydrofuran (THF), 2-dimethyl amino-2-methyl-1-propanol, 2-diethyl amino ethanol, 1-diethyl amino-2,3-propanol and the like. Basic solvents such as dimethyl aminoethanol or the less basic THF, may be employed as dispersion agents to assist the dispersion of the conductive particles in the polymer solution. Generally, the basic solvent has a pH value of between about 8 and about 14. The dispersion agents (solvents) are removed in the coating drying step. Other typical solvents include DMF, and the like.

The preferred acid or neutral conductive particle-basic solution combination promotes excellent wetting of the binder polymers on the conductive particles. Good wetting of conductive particles ensures total encapsulation of the conductive by the binder, prevents aggregation of the conductive particles into large agglomerates, and enhances semitransparency. Thus, for example, small carbon black particles in a dispersion remain dispersed in a stable mixture until drying of the deposited coating is completed.

Any suitable coating technique may be employed to apply the conductive coating dispersion. Typical coating processes include, for example, spray coating, extrusion coating, draw-bar coating, spin coating, dip coating, wire coating, web coating, and the like. Preferably, the dispersion of conductive particles in a solution of binder matrix material is prepared in a concentrated form and subsequently diluted. The preferred total solids concentration in the dispersion is between about 10 and about 50 weight percent of the total dispersion weight. The dispersion can be prepared by conventional roll milling or attriting. The concentrated dispersion can be let down by adding appropriate solvents and thereafter applied to a substrate by, for example, spray coating, extrusion coating, draw-bar coating, spin coating, dip coating and the like.

The deposited conductive coating may be dried by any suitable process. Typical heating techniques include, for example, oven heating, infra red heating, forced air heating, and the like. Generally, the temperatures employed for heating should be sufficient to remove substantially all of the solvent from the coating. Also, the temperature applied and the time utilized for drying depends upon the specific materials employed and the degree of cross-linking desired.

The conductive layer coating mixture is applied to the surface of the supporting substrate. The conductive layer coating mixture of this invention may be applied by any suitable conventional technique. Typical application techniques include spraying, dip coating, roll coating, wire wound rod coating, drawbar coating, and the like. Coating compositions are usually applied with the polymer dissolved in a solvent. Typical solvents include, for example, Dowanol PM, DMF, THF, methanol, n-butanol, and the like, and mixtures thereof. Choice of solvents for the conductive layer depends upon the nature of the supporting substrate upon which the conductive layer is applied and also on the properties of the polymers constituting the conductive layer. Because the dried conductive layer is preferrably cross-linked or partially cross-linked, it is substantially insoluble in any solvent selected for application of subsequently applied layers. Appropriate solvents can, in general, be selected based on the known properties of the individual polymers, as is well known in the art. Mixtures of solvents may also be used, if desired. The proportion of solvent to be utilized varies with the type of coating technique to be employed, e.g., dip coating, spray coating, wire wound bar coating, roll coating, drawbar coating, and the like so that the viscosity and volatility of the coating mixture is adjusted to the type of coating technique utilized. Generally, the amount of solvent ranges from between about 99.8 percent by weight to about 90 percent by weight, based on the total weight of the coating composition. Typical combinations of specific solvents and polymers include, for example, alkyl acrylamidoglycolate alkyl ether derived polymer, such as methyl acrylamidoglycolate alkyl ether-vinyl pyridine copolymer, and 1-methoxy-2-hydroxypropane (Dowanol PM, available from Dow Chemical Co.) and dimethylaminoethanol. High boiling dipolar aprotic solvents such as dimethylformamide, dimethylacetamide and N-methylpyrrolidone (DMF, DMAC and NMP respectively) also dissolve alkyl acrylamidoglycolate alkyl ether derived polymer, such as methyl acrylamidoglycolate alkyl ether-vinyl pyrrolidone copolymer.

If desired, minor amounts of optional additives may be added to the conductive layer coating composition or blocking layer coating composition to promote improved wetting of the underlying surface. Any suitable additive may be employed. Typical additives include wetting agents such as Surfynol (available from Air Products and Chemicals, Inc.), and the like. Other additives include plasticizers such as glycerol, diethylene glycol, p-toluene ethyl sulfonamide, and the like. Similarly, other additives such as dyes and the like may also be added. Generally, the amount of optional additive added should be less than about 2 percent by weight, based on the total weight of the dried conductive layer coating.

If the conductive or blocking layer polymer is soluble in any of the organic solvents used in coating subsequent layers, the thickness uniformity and integrity thereof could be adversely affected because the organic solvents may wash the conductive and/or blocking layer material into the charge generating layer and/or charge transport layer. Thinner blocking layer or areas devoid of blocking layer material can result in very poor or even negligible device charge acceptance and high dark charge decay rate.

After the conductive layer or blocking layer coating is applied, the deposited coating is heated to drive out the solvent and form a solid continuous film. Generally, a drying temperature between about 110° C. and about 135° C. is preferred for drying the conductive layer and to ensure sufficient cross-linking of the copolymer in the absence of an acid catalyst. Lower temperatures may be employed if an acid catalyst is used. For conductive layers, the copolymer should be sufficiently cross-linked to ensure substantial insolubility in solvents employed to apply the blocking layer. Although cross-linking of the polymers in the conductive layer is preferred, the polymers need not be cross-linked during drying. However, the dried conductive layer polymers should be substantially insoluble in solvents employed to apply subsequent layers. Thus, if the polymers to be employed in the dried layers are soluble in solvents used to apply subsequent coatings because the polymers are linear, the polymers should be sufficiently cross-linked in the dried coatings so that they are insoluble when the other coatings are subsequently applied. The drying temperature selected also depends to some extent on the temperature sensitivity of the substrate. The drying temperature may be maintained by any suitable technique such as ovens, forced air ovens, radiant heat lamps, and the like. The drying time also depends upon the temperatures used. Thus, less time is required when higher temperatures are employed. Generally, increasing the drying time increases the amount of solvent removed. One may readily determine whether sufficient drying has occurred by chromatographic or gravimetric analysis. A typical treatment for the conductive layer involves application of the coating with a half mil Bird coating bar followed by heating of the deposited coating at 5° C. for about 10 to 30 minutes.

When the conductive layer of this invention is employed in an electrophotographic imaging member, i.e. a photoreceptor, an optional charge blocking layer may be interposed between the conductive layer and an imaging layer. The imaging layer comprises at least one photoconductive layer. The optional blocking layer material blocks positive charges. The charge blocking layer should be uniform, continuous and coherent and may comprise any suitable blocking material. Typical blocking materials include, for example, polyvinyl alcohol, polyvinyl butyral, polyvinylchloride, polyesters, polyamides, cellulose, polymethyl mathacrate, polyvinyl phenol, and the like. A polymer having a backbone derived from methylacrylamido-glycolate alkyl ether also forms an excellent blocking layer. If desired, the polymer derived from methylacrylamido-glycolate alkyl ether may be employed in the blocking layer as a linear homopolymer or copolymer or as a cross-linked or partially cross-linked homopolymer or copolymer. Generally, the thickness of the blocking layer depends on the hole injecting capability of the conductive layer. Satisfactory results may be achieved with a dried coating having a thickness between about 0.02 micrometer and about 8 micrometers. When the thickness of the layer exceeds about 8 micrometers, the electrophotographic imaging member may show poor discharge characteristics and residual voltage build-up after erase during cycling. A thickness of less than about 0.05 micrometer generally tends to result in pin holes as well as high dark decay and low charge acceptance due to nonuniformity of the thickness of different areas of the blocking layer. The preferred thickness range is between about 0.5 micrometer and about 1.5 micrometers. To illustrate how a specific composition selected for the ground plane will influence the thickness of the blocking layer selected, a photoreceptor utilizing a partially charge injecting ground plane layer containing dispersed carbon black ground plane without an overlying blocking layer charges to either about 3 volts/micrometer or 20 volts/micrometer, depends on the type of the polymer binders employed. When a sufficiently thick blocking layer is applied over the ground plane layer containing copper iodide, the photoreceptor will charge to levels at least about 30 volts/micrometer. Charge levels of at least about 30 volts/micrometer are preferred with optimum results being achieved at levels of at least about 40 volts/micrometer. At levels below about 20 volts/micrometer, contrast potential and lighter images cannot be developed with two-component dry xerographic developers. The surface resistivity of the dry blocking layer should be greater than about $10^{10}$ ohms/sq as measured at room temperature (25° C.) and one atmosphere pressure under 40 percent relative humidity conditions. This minimum electrical resistivity prevents the blocking layer from becoming too conductive.

The optional blocking layer coating mixture is applied to the surface of the supporting substrate and the surface of the conductive layer, respectively. The blocking layer coating mixture may be applied by any suitable conventional technique. Typical application techniques include spraying, dip coating, roll coating, wire wound rod coating, and the like. Coating compositions are usually applied with the polymer dissolved in a solvent. Typical solvents include methanol, 1-methoxy-2-hydroxypropane, tertiary butyl alcohol, water and mixtures of these solvents with other alcohol solvents and tetrahydrofuran and the like. Choice of solvents for the blocking layer depends upon the nature of the properties of the polymers constituting the blocking layer. The dried blocking layer should be-substantially insoluble in any solvent selected for application of subsequently applied layers. Appropriate solvents can, in general, be selected based on the known properties of the individual polymers, as is well known in the art. Mixtures of solvents may also be used, if desired. The proportion of solvent to be utilized varies with the type of coating technique to be employed, e.g., dip coating, spray coating, wire wound bar coating, roll coating, and the like so that the viscosity and volatility of the coating mixture is adjusted to the type of coating technique utilized. Generally, the amount of solvent ranges from between about 99.8 percent by weight to about 90 percent by weight, based on the total weight of the coating composition. Typical combinations of specific solvents and polymers include, for example, gelatin polymer and water, alkyl acrylamidoglycolate alkyl ether derived polymer, such as poly methyl acrylamidoglycolate alkyl ether, and 1-methoxy-2-hydroxypropane (Dowanol PM, available from Dow Chemical Co.) or tertiary butyl alcohol. Basic alcohols such as dimethylaminoethanol and acidic alcohols such as 2,2,2-trifluoroethanol also dissolve alkyl acrylamidoglycolate alkyl ether derived polymer, such as poly methyl acrylamidoglycolate alkyl ether, significantly at room temperature but solvent neutrality is usually desirable to avoid interference with the ground plane or other layers affecting photoreceptor electrical performance due to residual trace amounts of solvent. High boiling dipolar aprotic solvents such as dimethylformamide, dimethylacetamide and N-methylpyrrolidone (DMF, DMAC and NMP respectively) also dissolve alkyl acrylamidoglycolate alkyl ether derived polymer extensively but are less desirable because total solvent removal from the coatings is more difficult to achieve due to the high boiling points of these solvents.

If desired, minor amounts of optional additives may be added to the blocking layer coating composition to promote improved wetting of the underlying surface. Any suitable additive may be employed. Typical additives include wetting agents such as Surfynol (available from Air Products and Chemicals, Inc.), and the like. Other additives include plasticizers such as glycerol, diethylene glycol, p-toluene ethyl sulfonamide, and the like. Similarly, other additives such as dyes and the like may also be added. Generally, the amount of optional additive added should be less than about 2 percent by weight, based on the total weight of the dried conductive layer or blocking layer coating.

If the blocking layer polymer is soluble in any of the organic solvents used in coating subsequent layers, the thickness uniformity and integrity thereof could be adversely affected because the organic solvents may wash the conductive and/or blocking layer material into the charge generating layer and/or charge transport layer. Thinner blocking layer or areas devoid of blocking layer material can result in very poor or even negligible device charge acceptance and high dark charge decay rate.

After the optional blocking layer coating is applied, the deposited coating is heated to drive out the solvent and form a solid continuous film. Generally, a drying temperature between about 80° C. and about 130° C. is preferred for drying the blocking layer. For drying of the blocking layer coating, a temperature of between about 110° C. and about 135° C. is preferred to minimize any residual solvent, to minimize any distortion to organic film substrates such as biaxially oriented polyethylene terephthalate. Although cross-linking of the polymers in the and blocking layers is preferred, the polymers need not be cross-linked during drying. For forming dried blocking layers containing linear polymers, the drying temperature and time should be sufficient to remove the coating solvent, but insufficient to cross-link the polymer. However, the dried blocking layer polymers should be substantially insoluble in solvents employed to apply subsequent layers. Thus, if the polymers to be employed in the dried layers are soluble in solvents used to apply subsequent coatings because the polymers are linear, the polymers should be sufficiently cross-linked in the dried coatings so that they are insoluble when the other coatings are subsequently applied. The drying temperature selected also depends to some extent on the temperature sensitivity of the substrate. The drying temperature may be maintained by any suitable technique such as ovens, forced air ovens, radiant heat lamps, and the like. The drying time also depends upon the temperatures used. Thus, less time is required when higher temperatures are employed. Generally, increasing the drying time increases the amount of solvent removed. One may readily determine whether sufficient drying has occurred by chromatographic or gravimetric analysis. A typical treatment for the blocking layer involves application of the coating with a half mil Bird coating bar followed by heating of the deposited coating at 130° C. for about 10 to 30 minutes.

Some of the blocking layer materials can form a layer which also functions as an adhesive layer. However, if desired, an optional adhesive layer may be utilized. Any suitable adhesive material may be applied to the blocking layer. Typical adhesive materials include polyesters (e.g. 49000, available from E. I. duPont de Nemours & Co. and PE100 and PE200, available from Goodyear Tire & Rubber Co.) polyvinylbutyral, polyvinyl formal, polyvinylpyrrolidone, polyamide, polyurethane, polyvinyl acetate, polyvinyl chloride, polyimide, polycarbonate, copolymers thereof, blends thereof and the like. Generally, satisfactory results may be achieved with adhesive layers having a thickness of between about 0.01 micrometer to about 1 micrometer. A preferred thickness is from about 0.02 micrometer to about 0.12 micrometer. Optimum results are achieved with a thickness of about 0.03 micrometer (300 angstroms) to about 0.12 micrometer from materials such as polyvinyl pyridine. Adhesive layers are especially useful for enhancing adhesion to charge generation layers containing materials, such as polyvinyl carbazole, which adhere poorly to vinyl hydroxy ester or vinyl hydroxy amide blocking layer polymers. Typical adhesive layer materials are those producing strong hydrogen bonds with vinyl hydroxy ester or vinyl hydroxy amide polymers such as poly(4-vinylpyridine), poly(2-vinylpyridine), and the like. Adhesive layers containing poly(4-vinylpyridine) form a hydrogen bonded polymeric complex with vinyl hydroxy ester or vinyl hydroxy amide blocking layer polymers which are believed to be unique adhesive compositions having solubility properties which allow the adhesive layer to also function as a solvent barrier layer.

Generally, as described above and hereinafter, the electrophotoconductive imaging member of this invention comprises a substrate coated with a continuous, optionally semi-transparent conductive layer comprising a fine dispersion of conductive particles-in a continuous charge transport matrix comprising a cross-linked, partially cross-linked or linear film forming polymer. For photoreceptor applications, the electrically conductive layer may be coated with an optional blocking layer, an optional adhesive layer and at least one photoconductive imaging layer. The photoconductive layer may comprise any suitable photoconductive material well known in the art. Thus, the photoconductive layer may comprise, for example, a single layer of a homogeneous photoconductive material or photoconductive particles dispersed in a binder, or multiple layers such as a charge generating overcoated with a charge transport layer. The photoconductive layer may contain homogeneous, heterogeneous, inorganic or organic compositions. One example of an electrophotographic imaging layer containing a heterogeneous composition is described in U.S. Pat. No. 3,121,006 wherein finely divided particles of a photoconductive inorganic compound are dispersed in an electrically insulating organic resin binder. The entire disclosure of this patent is incorporated herein by reference. Other well known electrophotographic imaging layers include amorphous selenium, halogen doped amorphous selenium, amorphous selenium alloys including selenium arsenic, selenium tellurium, selenium arsenic antimony, and halogen doped selenium alloys, cadmium sulfide and the like. Generally, these inorganic photoconductive materials are deposited as a relatively homogeneous layer.

This invention is particularly desirable for electrophotographic imaging layers which comprise two electrically operative layers, a charge generating layer and a charge transport layer.

Any suitable charge generating or photogenerating material may be employed as one of the two electrically operative layers in the multilayer photoconductor embodiment of this invention. Typical charge generating materials include metal free phthalocyanine described in U.S. Pat. No. 3,357,989, metal phthalocyanines such as copper phthalocyanine, vanadyl phthalocyanine, selenium containing materials such as trigonal selenium, bisazo compounds, quinacridones, substituted 2,4-diaminotriazines disclosed in U.S. Pat. No. 3,442,781, and polynuclear aromatic quinones available from Allied Chemical Corporation under the tradename Indofast Double Scarlet, Indofast Violet Lake B, Indofast Brilliant Scarlet and Indofast Orange. Other examples of charge generator layers are disclosed in U.S. Pat. Nos. 4,265,990, 4,233,384, 4,471,041, 4,489,143, 4,507,480, 4,306,008, 4,299,897, 4,232,102, 4,233,383, 4,415,639 and 4,439,507. The disclosures of these patents are incorporated herein by reference in their entirety.

Any suitable inactive resin binder material may be employed in the charge generator layer. Typical organic resinous binders include polycarbonates, acrylate polymers, methacrylate polymers, vinyl polymers, cellulose polymers, polyesters, polysiloxanes, polyamides, polyurethanes, epoxies, polyvinylacetals, and the like. Many organic resinous binders are disclosed, for example, in U.S. Pat. No. 3,121,006 and U.S. Pat. No. 4,439,507, the entire disclosures of which are incorporated herein by reference. Organic resinous polymers may be block, random or alternating copolymers. The photogenerating composition or pigment is present in the resinous binder composition in various amounts. When using an electrically inactive or insulating resin, it is essential that there be particle-to-particle contact between the photoconductive particles. This necessitates that the photoconductive material be present in an amount of at least about 15 percent by volume of the binder layer with no limit on the maximum amount of photoconductor in the binder layer. If the matrix or binder comprises an active material, e.g. poly-N-vinylcarbazole, the photoconductive material need only to comprise about 1 percent or less by volume of the binder layer with no limitation on the maximum amount of photoconductor in the binder layer. Generally for charge generator layers containing an electrically active matrix or binder such as poly-N-vinyl carbazole or phenoxy [poly(hydroxyether)], from about 5 percent by volume to about 60 percent by volume of the photogenerating pigment is dispersed in about 40 percent by volume to about 95 percent by volume of binder, and preferably from about 7 percent to about 30 percent by volume of the photogenerating pigment is dispersed in from about 70 percent by volume to about 93 percent by volume of the binder. The specific proportions selected also depends to some extent on the thickness of the generator layer.

The thickness of the photogenerating binder layer is not particularly critical. Layer thicknesses from about 0.05 micrometer to about 40.0 micrometers have been found to be satisfactory. The photogenerating binder layer containing photoconductive compositions and/or pigments, and the resinous binder material preferably ranges in thickness of from about 0.1 micrometer to about 5.0 micrometers, and has an optimum thickness of from about 0.3 micrometer to about 3 micrometers for best light absorption and improved dark decay stability and mechanical properties.

Other typical photoconductive layers include amorphous or alloys of selenium such as selenium-arsenic, selenium-tellurium-arsenic, selenium-tellurium, and the like.

The active charge transport layer may comprise any suitable transparent organic polymer or non-polymeric material capable of supporting the injection of photogenerated holes and electrons from the charge generation layer and allowing the transport of these holes or electrons through the organic layer to selectively discharge the surface charge. The active charge transport layer not only serves to transport holes or electrons, but also protects the photoconductive layer from abrasion or chemical attack and therefore extends the operating life of the photoreceptor imaging member. The charge transport layer should exhibit negligible, if any, discharge when exposed to a wavelength of light useful in xerography, e.g. 4000 Angstroms to 8000 Angstroms. Therefore, the charge transport layer is substantially transparent to radiation in a region in which the photoconductor is to be used. Thus, the active charge transport layer is a substantially non-photoconductive material which supports the injection of photogenerated holes or electrons from the generation layer. The active transport layer is normally transparent when exposure is effected through the active layer to ensure that most of the incident radiation is utilized by the underlying charge carrier generator layer for efficient photogeneration. When used with a transparent substrate, imagewise exposure may be accomplished through the substrate with all light passing through the substrate. In this case, the active transport material need not be absorbing in the wavelength region of use. The charge transport layer in conjunction with the generation layer in the instant invention is a material which is an insulator to the extent that an electrostatic charge placed on the transport layer is not conductive in the absence of illumination, i.e. does not discharge at a rate sufficient to prevent the formation and retention of an electrostatic latent image thereon.

The active charge transport layer may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer.

An especially preferred transport layer employed in one of the two electrically operative layers in the multilayer photoconductor embodiment of this invention comprises from about 25 to about 75 percent by weight of at least one charge transporting aromatic amine compound, and about 75 to about 25 percent by weight of a polymeric film forming resin in which the aromatic amine is soluble.

Examples of charge transporting aromatic amines represented by the structural formulae above for charge transport layers capable of supporting the injection of photogenerated holes of a charge generating layer and transporting the holes through the charge transport layer include triphenylmethane, bis(4-diethylamine-2-methylphenyl)phenylmethane; 4'-4''-bis(diethylamino)-2',2''-dimethyltriphenyl-methane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3''-methylphenyl)-(1,1'-biphenyl)-4,4'-diamine, and the like dispersed in an inactive resin binder.

Any suitable inactive resin binder soluble in methylene chloride or other suitable solvent may be employed in the process of this invention. Typical inactive resin binders soluble in methylene chloride include polycarbonate resin, polyvinylcarbazole, polyester, polyarylate, polystyrene, polyacrylate, polyether, polysulfone, and the like. Molecular weights can vary from about 20,000 to about 1,500,000.

The preferred electrically inactive resin materials are polycarbonate resins have a molecular weight from about 20,000 to about 100,000, more preferably from about 50,000 to about 100,000. The materials most preferred as the electrically inactive resin material is poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from the General Electric Company; a polycarbonate resin having a molecular weight of from about 50,000 to about 100,000, available as Makrolon from Farbenfabricken Bayer A. G., a polycarbonate resin having a molecular weight of from about 20,000 to about 50,000 available as Merlon from Mobay Chemical Company and poly(4,4'-diphenyl-1,1-cyclohexane carbonate). Methylene chloride solvent is a particularly desirable component of the charge transport layer coating mixture for adequate dissolving of all the components and for its low boiling point. However, the type of solvent selected depends on the specific resin binder utilized.

In all of the above charge transport layers, the activating compound which renders the electrically inactive polymeric material electrically active should be present in amounts of from about 15 to about 75 percent by weight.

If desired, the charge transport layer may comprise any suitable electrically active charge transport polymer instead of a charge transport monomer dissolved or dispersed in an electrically inactive binder. Electrically active charge transport polymer employed as charge transport layers are described, for example in U.S. Pat. Nos. 4,806,443, 4,806,444, and 4,818,650, the entire disclosures thereof being incorporated herein by reference.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like. Generally, the thickness of the transport layer is between about 5 micrometers to about 100 micrometers, but thicknesses outside this range can also be used.

The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer to the charge generator layer is preferably maintained from about 2:1 to 200:1 and in some instances as great as 400:1.

Optionally, an overcoat layer may also be utilized to improve resistance to abrasion. In some cases a back coating may be applied to the side opposite the photoreceptor to provide flatness and/or abrasion resistance. These overcoating and backcoating layers may comprise organic polymers or inorganic polymers that are electrically insulating or slightly semi-conductive.

The electrical conductivity of many conductive layers for photoreceptors are unstable and change with changes in ambient humidity. It is important that the conductivity of these conductive layers be stable under different environmental conditions, such as different humidities. If the conductivity of the conductive layers changes to too low a value at a given humidity, nonuniform charging of the photoreceptor surfaces will occur. This would lead to nonuniform print quality. The conductive layer of this invention exhibits greatly improved electrical conductivity stability under wide fluctuations in ambient humidity and extends the life of electrostatographic imaging members. Moreover, cross-linking the ground plane polymer containing a particulate conductive substance, such as a conductive carbon black, ensures network enclosure of the conductive particles, thus imparting greater solvent resistance (chemical stability) to subsequently used solvent coating compositions. The possibility of particle escape and upward migration into the other layers of the photoreceptor where deleterious hole injection would occur is eliminated in cross-linked solvent resistant ground planes. Thus, the electrostatographic imaging member of this invention allows photodischarge with low residual voltage during cycling under wide ambient relative humidities (<5 to 80%). This enables total discharge within the xerographic time scale, and thus low $V_R$ initially and with repetitive cycling.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

A conductive layer was coated from a carbon black-/polymer dispersion. The dispersion was prepared by first dissolving 2.1 gms MAGME-vinylpyrrolidone copolymer in a solvent mixture consisting of 21 gms Dowanol PM solvent and 2 grms dimethylaminoethanol and then adding 0.51 gm N,N'-bis(3"hydroxyphenyl)-[1,1'biphenyl]-4,4"diamine (BHBD). After the dissolution of N,N'-bis(3"hydroxyphenyl)-[1,1'biphenyl]-4,4"diamine, 0.53 gm carbon black (C-975 Ultra) and 70 grms of one-eighth inch steel shot were added and the mixture was dispersed for 90 minutes in a paint shaker. The dispersion was then diluted by adding another 20 grms of Dowanol PM. The diluted dispersion was then filtered through a 5 micrometer filter and coated onto a thin polyethylene terephtalate sheet by a draw bar having a 5 mil gap. The coating was dried and crosslinked for one and half hour at 135° C. The resistivity of the coating was measured at different temperatures and humidity by a four-point probe resistivity measurement arrangement. The resistivity of the coating was virtually independent of the temperature and humidity. Measurements on a sister coating, fabricated from a dispersion identical to this formula, except for no doping of N,N'-bis(3"hydroxyphenyl)-[1,1'biphenyl]-4,4"diamine, were also made for comparison. The results are shown in the Table 1.

TABLE 1

| Conductive Layer | Temperature °C. | Relative Humidity | Resistivity ohms/square |
|---|---|---|---|
| with BHBD | 18 | <5% | $1.3 \times 10^4$ |
| " | 18 | 37% | $1.3 \times 10^4$ |
| " | 18 | 69% | $1.7 \times 10^4$ |
| " | 83 | <5% | $1.2 \times 10^4$ |
| without BHBD | 20 | <5% | $1.6 \times 10^4$ |
| without BHBD | 20 | 35% | $1.7 \times 10^4$ |
| without BHBD | 20 | 69% | $3.6 \times 10^5$ |
| without BHBD | 80 | <5% | $1.6 \times 10^4$ |

The presence of N,N'-bis(3"hydroxyphenyl)-[1,1'biphenyl]-4,4"diamine eliminated the humidity effect on the coating resistivity.

Over 95 weight percent of N,N'-bis(3"hydroxyphenyl)-[1,1'biphenyl]-4,4"diamine was found to bond to the MAGME-vinylpyrrolidone polymer after the heat treatment. The experiment was performed by preparing the following solution: 0.8004 gram MAGME-vinylpyrrolidone polymer, 0.2089 grm N,N'-bis(3"hydroxyphenyl)-[1,1'biphenyl]-4,4"diamine, 8 grams Dowanol PM and 0.76 grams dimethylaminoethanol. 0.35 gm of the prepared solution was weighted to each of two 25 cc volumetric flasks. The N,N'-bis(3"hydroxyphenyl)-[1,1'biphenyl]-4,4"diamine, MAGME-vinylpyrrolidone and solvent ratios are within the typical concentration range used in the ground plane coatings as described above. One flask was heated at 135° C. for one and half hours and the other was dried in a vacuum oven at ambient conditions overnight. Twenty-five cc of tetrahydrofuran (THF) was added to each flask again. The flasks were allowed to stand overnight to extract out the unbonded N,N'-bis(3"hydroxyphenyl)-[1,1'biphenyl]-4,4"diamine. The solutions were then pipetted out and the visible absorption spectra were determined. The N,N'-bis(3"hydroxyphenyl)-[1,1'biphenyl]-4,4"diamine in THF solvent showed three distinct peaks between 240 and 400 nm. The extinction coefficients were determined for each peak from a N,N'-bis(3"hydroxyphenyl)-[1,1'biphenyl]-4,4"diamine/THF solution of known concentration. The extracted N,N'-bis(3"hydroxyphenyl)-[1,1'biphenyl]-4,4"diamine concentration for those two experimental flasks were then determined by measuring the absorption peak heights and the extinction coefficients. The results showed that with no heat treatment, 65 weight percent of N,N'-bis(3''hydroxyphenyl)-[1,1'biphenyl]-4,4''diamine was extracted out, however, less than 3 weight percent of N,N'-bis(3''hydroxyphenyl)-[1,1'biphenyl]-4,4''diamine was extracted out from the heat treated mixture. Therefore, most of the N,N'-bis(3''hydroxyphenyl)-[1,1'biphenyl]-4,4''diamine was chemically bonded to the MAGME-vinylpyrrolidone by such a heat treatment and cannot be mixed into the subsequent coatings and cause electrical problems, such as low surface charging. The transparency of both coatings were about 10% to white light.

EXAMPLE II

Two conductive layers can be coated from a carbon black/polymer dispersion. The dispersion can be prepared in the same manner as described in the Example I. The only difference from Example I is the replacement of the MAGME-vinylpyrrolidone copolymer (33–67 molar ratio) with n-phenyl malenimide-styrene copolymer in one coating and styrene-maleic anhydride copolymer for the other coating. Dry THF can be used as the solvent to dissolve the styrene-maleic anhydride copolymer and N,N'-bis(3''hydroxyphenyl)-[1,1'biphenyl]-4,4''diamine instead of the Dowanol PM and dimethylaminoethanol mixture used in the Example I. The dispersion can be coated and dried the same manner as described in the Example I. Similar results on the transparency, conductivity and crosslinking as those shown in the Example I is expected.

EXAMPLE III

A photoreceptor device consisting of six layers was fabricated. The device consisted of six layers. The conductive layer was prepared the in the same manner as the one with the BHBD dopant in the binder, described in the Example I. The upper 4 layers were subsequently draw bar coated from separate solutions. The blocking layer was prepared by coating a 6 weight percent HEMA solution in Dowanol PM onto the conductive layer with a drawbar of 0.5 mil gap. The coating was dried at 110° C. for 1 hour in an air convection oven. The dried coating had a thickness of about 1 micrometer. The adhesive layer was coated from a solution consisting of 0.5 gm polyester (49000, available from E. I. du Pont de Nemours & Co.), 70 gms THF and 29.5 grams cyclohexanone using a 0.5 mil gap draw bar. The coating was dried at 100° C. for 15 minutes. The photogeneneration layer, 1 micrometer in thickness, comprised 28.5 weight percent trigonal selenium, 16 weight percent N,N'-bis(3''methylphenyl)-[1,1'biphenyl]-4,4''diamine and 55.5 weight percent PVK was coated from a dispersion with 13 percent total solid content in a 1:1 weight ratio of THF and toluene solvent mixture with a 0.5 mil draw bar gap. The coating was dried at 100° C. for one hour. The transport layer, having a thickness of 28 micrometers, comprised 40 weight percent N,N'-bis(3''methylphenyl)-[1,1'biphenyl]-4,4''diamine and 60 weight percent polycarbonate (Makrolon 5705, available from Farbensabricken Bayer A. G.). The coating was coated with a 4 mil draw bar gap from a solution consisting of 4.2 gms polycarbonate (Makrolon 5705) and 2.8 gms N,N'-bis(3''methylphenyl)-[1,1'biphenyl]-4,4''diamine and 40 gms methylene chloride. The coating was dried at ambient conditions for one hour and then slowly in an air convection oven from 50° C. to 110° C. in a period of 2 hours and then at 110° C. for 20 minutes. The device was thereafter electrically tested for 200 cycles in a cyclic scanner at ambient conditions (20.5° C. and 33 percent relative humidity). The device was corona charged negatively with a corona current density of 140 nanocoulombs/cm$^2$ and at these seconds per scanner cycle speed. A Xenon lamp was used for erase. The photoinduced discharge curve was also measured at a wavelength of 550 nm. The surface charge at 200 cycles was 1,421 volts at 0.19 second after charging, 1,200 volts at 1.17 seconds after charging and 30 volts after erase. The sensistivity was 231 V.cm$^2$/erg. The adhesion between the blocking and photogeneration layers was 3 grams/cm, as measured by an Instron instrument. The Instron Instrument measured the amount of forces needed to apply on a 1 cm wide strip of device in order to separate the layers of the device.

EXAMPLE IV

Two photoreceptor devices were fabricated with a structure similar to that described in the Example III. The only differences were that these two devices had no adhesive layer and had different photogeneration layers. One of the devices had a photogeneration layer coated from a selenium particle dispersion in a phenoxy polymer [PKHH, (85000 MW) from Union Carbide Co.]. The dispersion was prepared by dissolving 3.29 gms PKHH into a solvent mixture of 17.85 grams cyclohexanone and 18.58 grams acetone in a four ounce bottle. 6.58 grams selenium particles and 100 gms steel shot (one-eighth diameter) were added to this solution. The mixture was roll-milled for 5 days. The photogeneration layer was coated from this dispersion with a 0.5 mil gap draw bar and was dried at 110° C. for one hour. Another device was prepared with a photogeneration layer coated from a selenium particle dispersion in a polyvinylbutyral polymer (B-76, available from Monsanto Chemical Co.). The dispersion was prepared by dissolving 0.71 gm B-76 in a solvent mixture of 12 grams toluene and 4 grams THF in a 2 ounce bottle. 1.34 gms selenium particles and 100 gms steel shot (one-eigth diameter) were added to this solution. The mixture was roll-milled for 5 days and diluted by adding equal weights of a toluene/THF mixture (3/1 weight ratio). The layer was coated from this dispersion with a draw bar of 0.5 mil gap and was dried at 110° C. for one hour. The conductive, blocking and transport layers were fabricated in the same manner as described in the Example III. The devices were tested electrically in the same manner as described in the Example III. The surface charge at 200 cycles for the device with a Se/PKHH generator layer was measured to be 1108 volts at 0.19 second after charging, 866 volts at 1.17 seconds after charging and 60 volts after erase. The sensitivity was 311 V.cm$^2$/erg. The surface charge at 200 cycles for the device with Se/B-76 generator layer was measured to be 1365 volts at 0.19 second after charging, 1190 volts at 1.17 seconds after charging and 60 volts after erase. The sensitivity was 285 V.cm$^2$/erg. These devices showed good charging, low dark decay, low residual voltage after erase, good sensitivity and cyclic stability.

EXAMPLE V

Two photoreceptor devices can be fabricated with a structure similar to that described in the Example IV. The only differences should be that these two devices have different blocking layers. The blocking layers can be fabricated in the same manner as described in the Example III. The only difference will be the polymer and the solvent used to prepare for coating. Polyvinyl alcohol polymer and water will be used instead of HEMA and Dowanol PM solvent. The conductive, photogeneration and transport layers can be fabricated in the same manner as described in the Example IV. The devices will be tested electrically in the same manner as described in the example IV. Similar results as those described in the Example IV are expected.

EXAMPLE VI

Two photoreceptor devices can be fabricated with a structure similar to that described in the Example IV. The only differences should be that these two devices have different blocking layers. The blocking layers can be fabricated in the same manner as described in the Example III. The only difference should be the polymer and the solvent used to prepare the coating. A gelatin polymer and water can be used instead of HEMA and Dowanol PM solvent. The conductive, photogeneration and transport layers can be fabricated the same ways as described in the Example IV H. The devices can be tested electrically the same way as described in the example IV. Similar results as those described in the Example IV are expected.

EXAMPLE VII

A photoreceptor device with a structure similar to the one with the selenium particles dispersed in phenoxy polymer [PKHH, (85000 MW) from Union Carbide Co.] as the generator layer described in the Example IV was prepared. All layers were fabricated in a manner identical to the method described in the Example IV. The only differences were the drying conditions of the conductive and blocking layers. The conductive layer was dried at 90° C. for one hour only. The conductive layer was only partially crosslinked after the heat treatment. The conductive layer could be partially wiped off by a Q-Tip wetted with methanol solvent. The HEMA blocking layer was dried at 135° C. for one and half hours after coating. After the blocking layer drying was completed, the conductive layer was crosslinked and bonded to the blocking layer. This was evident from the fact that the adhesion force between the blocking and conductive layers was increased from 2 grams/cm to over 10 grams/cm. The device still showed good electrical properties, similar to those described in the Example IV. The device was tested electrically the same manner as described in the Example IV. The surface charge at 200 cycles was 1,142 volts at 0.19 second after charging, 916 volts at 1.17 second after charging and 50 volts after erase. The sensisitivity was 299 $V.cm^2/erg$.

EXAMPLE VIII

A photoreceptor device with a structure similar to the one with the selenium particles dispersed in polyvinylbutyral polymer (B-76, available from Monsanto Chemical Co.) as the generator layer described in the Example IV was prepared. The only differences were the conductive layer and generator layer formulae and polyethylene terephthalate sheet treatment. The polyethylenetere phthalate sheet was corona treated. The carbon black dispersion was formulated by dissolving 1.029 gram MAGME-vinylpyrrolidone (33–67 mole ratio) and 1.029 grams MAGME-vinyl acetate (50—50 mole ratio) into a solvent mixture of 10 grams Dimethylformamide (DMF) and 5 grams Dowanol PM. To this solution, 0.51 gram N,N'-bis(3''hydroxyphenyl)-[1,1'biphenyl]-4,4''diamine was added. After the dissolution of the N,N'-bis(3''hydroxyphenyl)-[1,1'biphenyl]-4,4''diamine, 0.54 gram carbon black (C-975 Ultra) and 70 grams of one-eigth steel shot were added. The mixture was then shaken in a paint shaker for one and half hours. The dispersion was then coated onto a corona treated polyethylene teraphthalate sheet with a number 14 Meyer rod. The coating was dried at 135° C. for one and half hours.

The charge generator layer was coated from a selenium particle dispersion in a polyvinylbutyral polymer (B-76 from Monsanto Chemical Co.). The dispersion was prepared by dissolving 1.88 gms B-76 in a solvent mixture of 12 grams toluene and 4 grams THF in a 2 ounce bottle. 1.88 grams selenium particles and 100 grams steel shot (one-eigth diameter) were added to this solution. The mixture was roll-milled for 5 days and diluted by adding an equal weight of a toluene/THF mixture (3/1 weight ratio). The layer was coated from this dispersion with a 0.5 mil gap draw bar and dried at 135° C. for 20 minutes. The device was tested electrically in the same manner as described in the Example IV. The surface charge at 200 cycles was 772 volts at 0.19 second after charging, 628 volts at 1.17 second after charging and 8 volts after erase. The sensitivity was 218 $V.cm^2/erg$. The device showed good charging, low dark decay, low residual voltage and good sensitivity.

This device was also peel tested with an Instron instrument. The force required to break the bond between the HEMA blocking layer and the conductive ground plane was greater than 10 grams/cm. The force needed to break the bond between the conductive ground plane and the polyethylene terephthalate substrate was over 10 grams/cm. On the other hand, the adhesion force between the conductive ground plane and the polyethylene terephthalate substrate was only about one gram/cm if the polyethylene terephthalate substrate was not corona treated. The adhesion force between the conductive ground plane and the photogeneration layer was also only about three grams/cm if no MAGME-vinyl acetate (50—50 mole ratio) was used in the ground plane binder. This low adhesion may be a acceptable for flexible seamless belt substrates if the ground strip layer (normally comprises carbon black disprsed in a film forming binder) covers weak adhesive layers which can deliminate while cycling over small rollers. Also, low adhesion can be acceptable where the substrate is rigid such as a rigid plastic drum.

EXAMPLE IX

A photoreceptor device with a structure similar to that described in the Example VIII can be prepared. All the layers except the substrate layer can be fabricated in a manner identical to the methods described in the Example VIII except that the substrate layer used can be a polyethylene terephlalate drum. The device can be tested electrically in the same manner as described in the Example VIII. Similar results as those described in the Example VIII are expected.

EXAMPLE X

A photoreceptor device with a structure similar to the one with the selenium/polyvinylbutyral polymer (B-76, available from Monsanto Chemical Co.) as the generator layer, described in the Example IV-was prepared. The only difference was that an adhesive layer was formed between the polyethylene terephlalate substrate and the conductive layer. The adhesive layer was prepared by dissolving 6 gms titanium acetyl acetonate (Tyzor TAA, available from E. I. du Pont de Nemours & Co.) in 417 grams THF and 177 grams cyclohexanone. The solution was draw bar coated onto the polyethelene terephthalate sheet with a 0.5 mil gap draw bar. The coating was dried at 110° C. for 20 minutes. The device was tested electrically in the same manner as described in the Example IV. Similar results as those described in the Example IV were obtained. The device was also peel tested with an Instron instrument. The force necessary to break the bond between the conductive ground plane and the polyethylene terephlalate substrate was greater than 10 grams/cm.

EXAMPLE XI

Two photoreceptor devices with a structure similar to the ones described in the Example VIII were fabricated. The only difference was the conditions for crosslinking the conductive layers.

Device number 1 had the conductive layer coated from a carbon black dispersion formulated as follows: 1.029 grams MAGME-vinylpyrrolidone (33–67 mole ratio) and 1.029 MAGME-vinyl acetate (50—50 mole ratio) were dissolved in a solvent mixture of 10 grams DMF and 5 grams Dowanol PM. To this solution, 0.51 gram N,N'-bis(3''hydroxyphenyl)-[1,1'biphenyl]-4,4''diamine was added. After the dissolution of the N,N'-bis(3''hydroxyphenyl)-[1,1'biphenyl]-4,4''diamine, 0.021 gram p-toluene sulfonic acid, 0.54 grams carbon black (C-975 Ultra) and 70 grams of one-eigth diameter steel shot were added. The mixture was then shaken in a paint shaker for one and half hours. The resulting dispersion was then coated onto corona treated polyethylene terephthalate with a Meyer rod (number 14). The conductive layer was dried at 135° C. for one and half hours.

Device number 2 had a conductive layer coated from a dispersion formula identical to that with BHBD dopant, described in Example III. The conductive coating for device number 2 was dried at 90° C. for one hour and, therefore, was only partially crosslinked. The devices were tested electrically in the same manner as described in the Example VIII. Both devices showed good electrical properties. The results are shown in the Table 2 below:

TABLE 2

| | Total thickness (micron) | V (0.19 second after charging) | V (1.13 second after charging) | V (after erase) | Sensitivity ($V.cm^2/erg$) |
|---|---|---|---|---|---|
| Device 1 | 31 | 935 | 689 | 12 | 239 |
| Device 2 | 32 | 1055 | 965 | 20 | 212 |

EXAMPLE XII

A photoreceptor device with a structure similar to that described in the Example IV was fabricated with selenium particles dispersed in polyvinylbutyral polymer (B-76, available from Monsanto Chemical Co.) as the generator layer. A ground plane was spray-fabricated using a carbon black dispersion. The dispersion was prepared by dissolving 13.2 gms MAGME-vinylpyrrolidone and 13.2 grams MAGME-vinyl acetate in 97 grms DMF and 49 grams Dowanol PM. 6.75 grms N,N'-bis(3''hydroxyphenyl)-[1,1'biphenyl]-4,4''diamine was then dissolved in this solution. 8.25 grams carbon black (C-975 Ultra) and 500 grams steel shots were added later. The mixture was then roll-milled for 5 days. The dispersion was then filtered through a 28 micrometer filter and diluted with 90 grams THF and 95 grams Dowanol PM. The diluted dispersion was then sprayed onto a polyethylene terephthalate sheet mounted on a metal drum. The polyethylene terephthalate sheet was previously draw-down coated with a polyester resin layer (49000, available from E. I. duPont de Nemours & Co.), the same manner as described in the Example III. The conductive coating was then dried at 135° C. for one hour. The coating had a resistivity value of about $10^4$ ohms/square. A HEMA blocking layer having a thickness of about 0.8 micrometers was also spray fabricated and dried at 110° C. for one hour. The generator layer was spray fabricated from a dispersion prepared from vanadyl phthalocyanine dispersed in polyester resin (PE-100, avialable from Goodyear Chemical Co.). The generator layer had a thickness of 0.74 micrometer. The generator layer was dried at 125° C. for 30 minutes. The transport layer was sprayed from a solution in a methylene chloride/1,1,2 trichloro ethane solvent mixture having a solids content of 40 weight percent N,N'-bis(3''methylphenyl)-[1,1'biphenyl]-4,4''diamine and 60 weight percent polycarbonate (Merlon, available from Mobay Chemical Co.). The transport layer was dried from room temperature to 135° C. for one hour and then at 135° C. for 20 minutes. The devices were tested electrically in the same manner as described in the Example IV. The photodischarge curve was measured at an exposure at 825 nm wavelength. Good surface charging, low dark decay, low residual voltage and good sensitivity were obtained. The results are shown in the Table 3 below:

TABLE 3

| V (0.19 second after charging) | V (1.13 second after charging) | V (after erase) | Sensitivity ($V.cm^2/erg$) |
|---|---|---|---|
| 920 | 831 | 6 | 89 |

EXAMPLE XIII

A photoreceptor device having a structure similar to that described in the Example VIII was fabricated onto a polyethylene terephthalate sheet. The ground plane was spray-fabricated from a carbon black dispersion similar to that described in the Example XII except that the binder comprised 22.4 gms MAGME-vinylpyrrolidone and 4 grms MAGME-vinylacetate. The generator layer was spray fabricated from a dispersion of selenium particles in polyvinylbutyral polymer (B-76, available from Monsanto Chemical Co.) in the same manner as described as in the Example VIII. All other layers were fabricated the same manner as described in Example XII. The opposite ends of the sheet were welded together to form a seamed belt and mounted in a Xerox 5028 copier. The seamed photoreceptor belt was then xerographically cycled in the Xerox 5028 copier and the resulting prints exhibited good resolution and uniformity.

Other modifications of the present invention will occur to those skilled in the art based upon a reading of the present disclosure. These are intended to be included within the scope of this invention.

What is claimed is:

1. An electrophotographic imaging member comprising a substrate, an electrically conductive layer comprising an organic charge transporting continuous phase and finely divided electrically conductive particles dispersed in said continuous phase, and at least one photoconductive layer.

2. An electrophotographic imaging member according to claim 1 wherein said continuous phase comprises an electrically insulating film forming binder having organic charge transport molecules dissolved or molecularly dispersed therein.

3. An electrophotographic imaging member according to claim 2 wherein said electrically conductive layer comprises between about 15 percent by weight about to 40 percent by weight of said charge transporting small molecules based on the total weight of said continuous phase.

4. An electrophotographic imaging member according to claim 1 wherein said charge transporting continuous phase comprises a charge transporting small molecule or a charge transporting polymer comprising charge transport units and said continuous phase comprises between about 5 percent and about 40 percent by weight of said small molecule or said charge transport units based on the total weight of said continuous phase.

5. An electrophotographic imaging member according to claim 1 wherein said continuous phase comprises a polymer which is at least partially cross-linked.

6. An electrophotographic imaging member according to claim 1 wherein said continuous phase comprises an electrically insulating charge transporting film forming binder.

7. An electrophotographic imaging member according to claim 6 wherein said film forming binder comprises a copolymer of maleimide or a maleic anhydride and a hydroxy polymer or diol molecule.

8. An electrophotographic imaging member according to claim 1 wherein said continuous phase comprises a copolymer of methyl acrylamidoglycolate alkyl ether and at least one other vinyl monomer.

9. An electrophotographic imaging member according to claim 1 wherein said charge transport molecules comprise one or more aromatic diamine charge transport molecules.

10. An electrophotographic imaging member according to claim 1 wherein said electrically conductive particles are particles of a metal or metal oxide having a conductivity of at least about 1 $(\text{ohm.cm})^{-1}$.

11. An electrophotographic imaging member according to claim 1 wherein said electrically conductive particles are particles of carbon black.

12. An electrophotographic imaging member according to claim 11 wherein said layer comprises about 10 percent and about 40 percent by volume of particles of carbon black, based on the total volume of said layer.

13. An electrophotographic imaging member according to claim 12 wherein said layer comprises about 15 percent and about 25 percent by volume of particles of carbon black, based on the total volume of said layer.

14. An electrophotographic imaging member according to claim 1 wherein said electrically conductive layer has a resistivity of less than about $10^8$ ohms/square.

15. An electrophotographic imaging member according to claim 1 wherein said electrically conductive particles having an average particle size less than about 10 micrometers.

16. An electrophotographic imaging member according to claim 1 wherein said electrically conductive layer has a thickness of between about 0.5 micrometer and about 5 micrometers.

17. An electrophotographic imaging member according to claim 1 wherein a charge blocking layer is interposed between said photoconductive layer said conductive layer and said photoconductive layer.

18. An electrophotographic imaging member according to claim 1 wherein said photoconductive layer comprises a charge generating layer and a charge transport layer.

19. An electrophotographic imaging process comprising providing an electrophotographic imaging member having an imaging surface, said imaging member comprising a supporting substrate, an electrically conductive layer comprising an organic charge transporting continuous phase and finely divided electrically conductive particles dispersed in said continuous phase and at least one photoconductive layer, forming a uniform electrostatic charge on said imaging surface, exposing said photoconductive layer to activating electromagnetic radiation in image configuration to form an electrostatic latent image on said imaging surface, depositing toner particles on said imaging surface to form a toner image in conformance to said electrostatic latent image, and transfering said toner image from said imaging surface to a receiving member.

20. An electrophotographic imaging process according to claim 19 wherein said continuous phase comprises an electrically insulating film forming binder having organic charge transport molecules dissolved or molecularly dispersed therein.

* * * * *